United States Patent [19]

Henkin et al.

[11] Patent Number: 4,965,893

[45] Date of Patent: Oct. 30, 1990

[54] HYDROTHERAPY MASSAGE METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 455,454

[22] PCT Filed: Jul. 12, 1988

[86] PCT No.: PCT/US88/02344

§ 371 Date: Feb. 24, 1989

§ 102(e) Date: Feb. 24, 1989

[87] PCT Pub. No.: WO89/00417

PCT Pub. Date: Jan. 26, 1989

Related U.S. Application Data

[63] Continuation-in-part of Ser. No. 138,514, Dec. 23, 1987, Pat. No. 4,813,086, which is a continuation-in-part of Ser. No. 72,409, Jul. 13, 1987, abandoned, which is a continuation-in-part of Ser. No. 843,151, Mar. 24, 1986, Pat. No. 4,679,258.

[51] Int. Cl.[5] ..... A61H 33/02

[52] U.S. Cl. ..... 4/542; 4/541; 4/544; 4/492; 128/66

[58] Field of Search ..... 4/541–544, 4/492, 491; 128/66, 38; 239/416.4, 416.5, 416, 428.5, 429, 413, 587

[56] References Cited

U.S. PATENT DOCUMENTS

| | | | |
|---|---|---|---|
| 4,220,145 | 9/1980 | Stamp et al. | 128/66 |
| 4,335,854 | 6/1982 | Reynoso | 4/542 X |
| 4,339,833 | 7/1982 | Mandell | 4/542 |
| 4,466,141 | 8/1984 | Starkey | 4/542 |
| 4,520,514 | 6/1985 | Johnson | 4/490 |
| 4,523,340 | 6/1985 | Watkins | 4/542 |
| 4,710,990 | 12/1987 | Morsey | 4/542 |
| 4,716,604 | 1/1988 | Watkins | 4/492 X |

*Primary Examiner*—Henry K. Artis

*Attorney, Agent, or Firm*—Freilich Hornbaker Rosen

[57] ABSTRACT

Hydrotherapy apparatus including a rigid elongated conduit having a supply orifice and a discharge orifice. The conduit is mounted for swivel movement to enable the discharge orifice to traverse a path characterized by a series of small circular or semicircular path segments linked by translational path segments. The conduit is moved along said path by reaction forces produced by the discharged stream. The stream is produced by a supplied water jet which entrains air and/or tub water, as selected by the user. Valve means are provided for selectively varying the amount of air entrainment and/or water entrainment and/or supplied water jet.

21 Claims, 15 Drawing Sheets

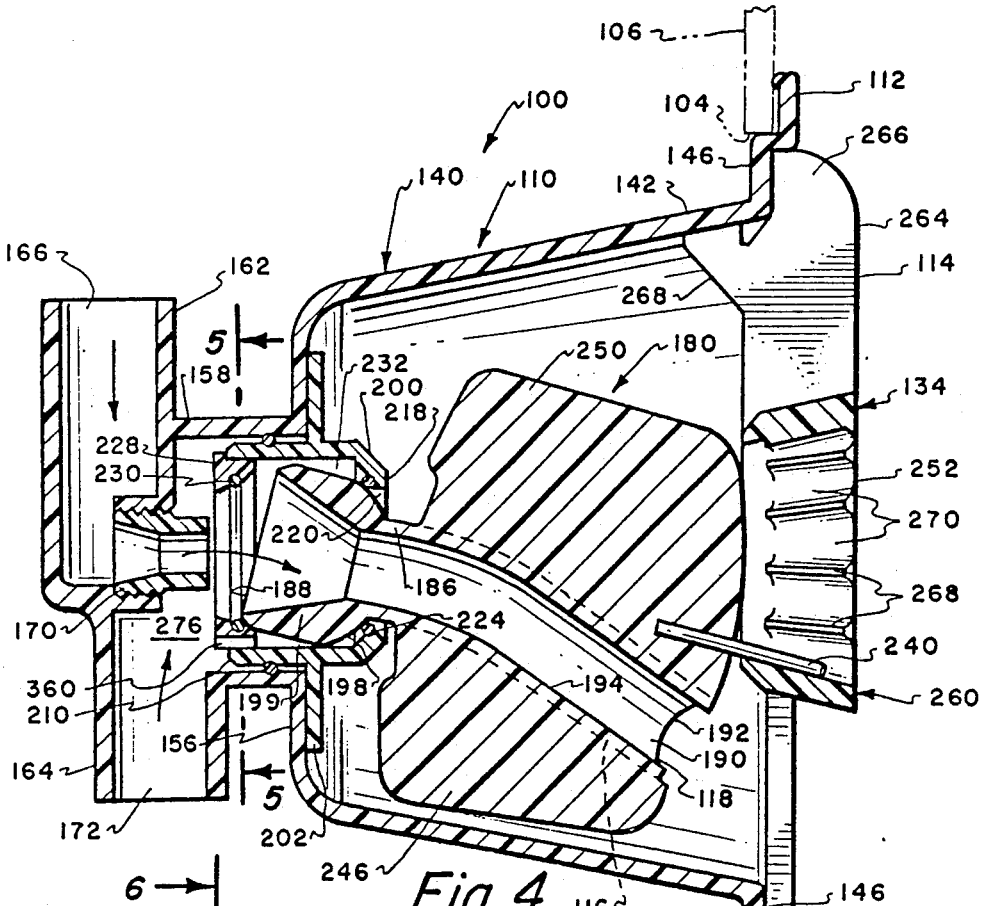
Fig. 4.
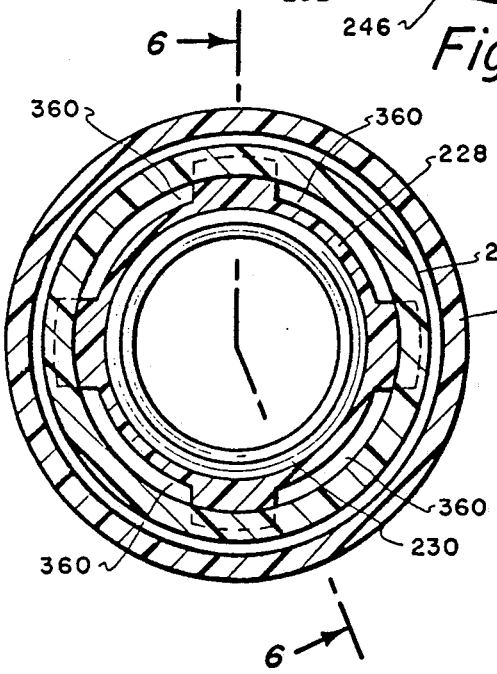
Fig. 5.
Fig. 6.

HYDROTHERAPY MASSAGE METHOD AND APPARATUS

This is a continuation-in-part of U.S. application Ser. No. 138,514 filed 23 December 1987 now U.S. Pat. No. 4,813,086, which was a continuation-in-part of U.S. application Ser. No. 072,409, filed 13 1987, now abandoned, which was a continuation-in-part of the application Ser. No. 843,141 filed 24 March 1986, issuing as U.S. Pat. No. 4,679,258 on 14 July 1987, all of whose disclosures are by reference incorporated herein. Related subject matter is disclosed in applicants' U S. Pat. Nos. 4,692,950; 4,689,839; 4,715,071; 4,726,080; 4,727,605; and 4,731,887, and U.S. application Ser. No. 170,718 filed 21 March 1988.

BACKGROUND OF THE INVENTION

This invention relates generally to hydrotherapy and more particularly to an improved method and apparatus useful in spas, hot tubs, bathtubs, and the like for discharging a fluid (e.g. water-air) stream while concurrently causing the stream to travel across an area so as to impact against and massage an area of a user's body.

Applicants' U.S. Pat. No. 4,679,258 discloses a method and apparatus for discharging a fluid stream, while concurrently causing the stream to travel along a substantially random path. A user is thus able to fixedly position his body proximate to the apparatus to enable the discharged stream to impact against and sweep over an area of the user's body. In a typical application, the apparatus is mounted in an opening in the peripheral wall (i.e. including floor) of a spa, hot tub, bathtub, etc., generically referred to as a water tub.

A preferred embodiment of the travelling discharge hydrotherapy apparatus disclosed in said U.S. Pat. No. 4,679,258 is characterized by the use of a water-air jet assembly including a nozzle for discharging a water jet under pressure into a mixing cavity. The water jet creates a suction, via venturi action, which draws air into the cavity and the resulting water-air stream is then discharged into an elongated rigid conduit having supply, intermediate and discharge sections. The conduit is open at both ends having a supply orifice at its supply section end and a discharge orifice at its discharge section end. The supply section outer wall is shaped to form a ball having a central bore defining said supply orifice. The ball is accommodated for swivel movement within a socket with the supply orifice open to the aforementioned mixing cavity. The conduit discharge end is left free to travel across a substantially planar travel area roughly approximating an extension of the tub wall. The water-air stream is discharged from the discharge orifice in a direction having a primary massage component extending substantially perpendicular to the travel area and having a secondary thrust component extending substantially parallel to the travel area. The thrust component produces a lateral force for moving the discharge end along a path lying within said travel area. The boundary of the travel area is substantially defined by a thrust modifier means in the form of a frame, which cooperates with a pivot pin secured to the conduit. The frame includes a series of open recesses, each intended to momentarily capture the pivot pin, as the conduit discharge end moves toward the area boundary. With the pivot pin so captured, the stream thrust component acts to rotate the discharge end around the pivot pin and thereby redirect the thrust component enabling the pivot pin to withdraw from its open recess and initiate a new traverse across the frame.

Thus, the discharge orifice will traverse a path comprised of small substantially semicircular path segments, each described when the pivot pin is engaged in a recess, linked by longer translational path segments extending between recesses. The translational recess-to-recess path segments extend substantially across the frame and occur in an essentially random unpredictable pattern.

Applicants' U.S. Pat. No. 4,715,071 discloses a travelling discharge hydrotherapy apparatus in which a passageway is provided around the swivel mounting of the conduit supply end for passing tub water from outside the conduit into the mixing cavity. As discussed therein, this action mitigates the effect of the suction force produced in the mixing cavity acting on the conduit itself.

Applicants' U.S. application Ser. No. 170,718 discloses a hydrotherapy jet assembly for discharging a water stream through an adjustable flow director. The assembly is capable of operating in an air entrainment mode and/or a tub water entrainment mode and includes a single valve control member enabling a user to adjust the amount of air entrainment and/or water entrainment and/or supplied water jet to selectively vary the intensity of the discharged stream.

SUMMARY OF THE INVENTION

The present invention is directed, inter alia, to alternative embodiments of the travelling discharge apparatus disclosed in said U.S. Pat. No. 4,679,258 which are structurally configured to provide improved massage performance.

In accordance with one aspect of the present invention, the conduit is specially configured to enable the discharge stream to produce a larger force for initiating and maintaining translational movement of the conduit discharge end.

In accordance with another aspect of the invention, the apparatus is configured to define a passageway proximate to the conduit supply end for permitting tub pool water to be drawn into the mixing cavity for the purpose of reducing friction loss in the swivel mounting and increasing the mass of the discharged stream.

In accordance with an additional aspect of the invention, the aforementioned open recesses for capturing the pivot pin are symmetrically arranged, preferably in a circular pattern, for influencing the conduit discharge orifice to traverse a more predictable path.

In accordance with a still additional aspect of the invention, an improved thrust modifier means is provided, configured to influence the conduit discharge orifice to traverse a path comprised of successive small substantially circular path segments linked by short translational path segments. More specifically, the open recesses are partially closed to allow the conduit pivot pin to escape only when the conduit is in a particular orientation. From this particular orientation, the forces produced by the stream discharged from the discharge orifice will normally move the pivot pin into an adjacent or near recess.

In accordance with another aspect of the invention, to avoid diminishment of the discharge stream attributable to a user placing his body tightly against the thrust modifier frame, the frame is preferably provided with radially extending openings to permit the discharge stream to readily flow from the discharge orifice without building up significant back-pressure in the conduit.

In accordance with a still additional aspect of the invention, valve means are incorporated in a travelling discharge hydrotherapy apparatus for enabling a user to selectively operate the apparatus in an air entrainment mode and/or a water entrainment mode. In the air entrainment mode, the suction produced in the mixing cavity will draw in air for mixing with the supplied water jet. In the water entrainment mode, the suction will draw in tub water for mixing with the supplied water jet.

In accordance with a further aspect of the invention, the valve means can be operated to selectively vary the amount of air and/or tub water entrained by the supplied water jet. Additionally, in accordance with still another aspect, valve means are incorporated for selectively varying the amount of water jet supplied.

In a preferred embodiment, the valve means includes a single control member for enabling a user to adjust the amount of air entrainment and/or water entrainment and/or supplied water jet to selectively vary the intensity of the stream discharged from the conduit discharge orifice. More specifically, the preferred embodiment includes an outer housing having an inner housing (or control member) concentrically mounted therein for limited angular rotation with respect thereto. For different degrees of angular rotation, water entrainment, air entrainment and the supplied water jet can be varied as exemplified by the following table:

| | Rotation Angle | Water Entrain | Water Supply | Air Entrain | Discharge Momentum |
|---|---|---|---|---|---|
| AIR | 0° (stop) | CLOSED | OPEN | OPEN | +4 |
| ENTRAIN. | | | . | . | . |
| MODE | 35° | CLOSED | SMALL | CLOSED | +½ |
| WATER | 40° | SMALL | SMALL | CLOSED | SMALL |
| ENTRAIN. | | . | . | | . |
| MODE | 75° (STOP) | OPEN | OPEN | CLOSED | +4 |

DESCRIPTION OF THE FIGURES

FIG. 4 is a sectional view taken substantially along the plane 4—4 of FIG. 1;

FIG. 5 is a sectional view taken substantially along the plane 5—5 of FIG. 4;

FIG. 6 is a sectional view taken substantially along the plane 6—6 of FIG. 5;

DETAILED DESCRIPTION

Figure 1:
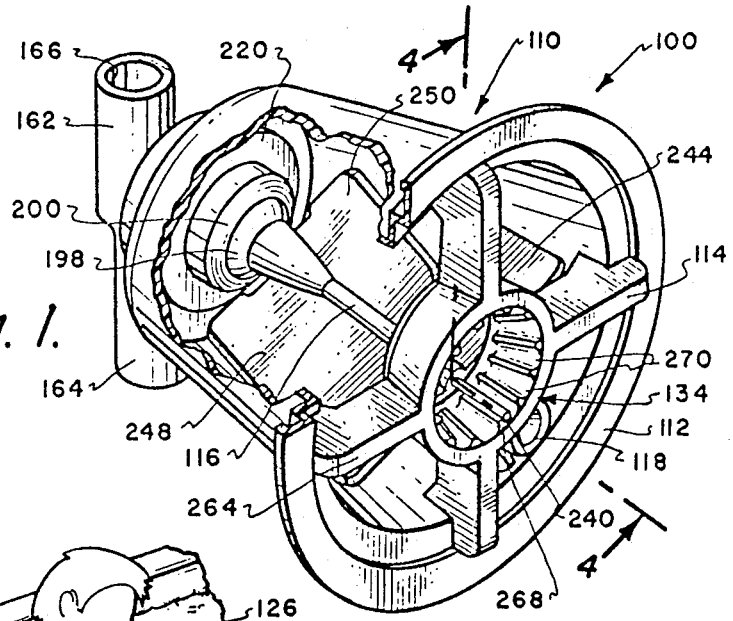
FIG. 1 is an isometric, partially broken away, view of a hydrotherapy apparatus in accordance with a first embodiment of the present invention.
Figure 2:
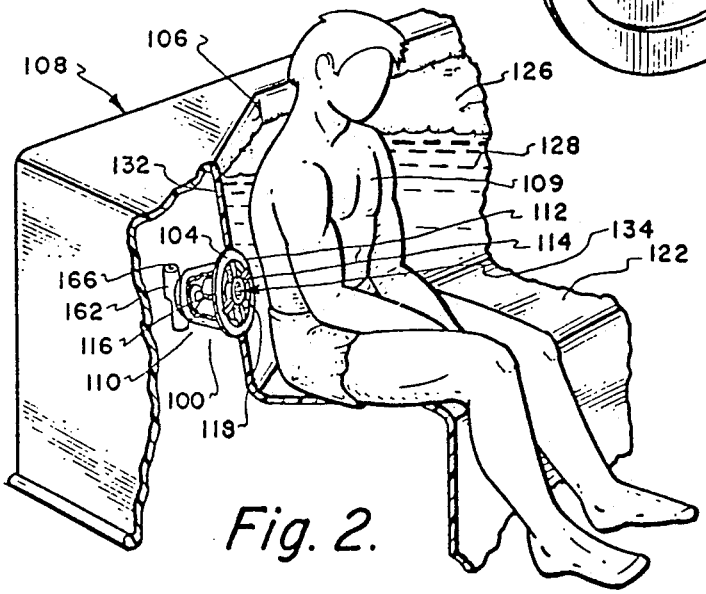
FIG. 2 is an isometric view, partially broken away, depicting the apparatus of FIG. 1 mounted behind the perimeter wall of a water tub.

Attention is initially directed to FIG. 1 which illustrates an isometric view of a travelling discharge hydrotherapy apparatus 100 in accordance with the present invention. The apparatus 100 is intended to be mounted in a discharge opening 104 of the peripheral wall 106 of a water tub 108 such as a spa, hot tub, or bath tub, as depicted in FIG. 2, for massaging the body of a user 109. Briefly, the apparatus 100 is comprised of a tapered substantially cylindrical housing 110 having an open front frame 112 adapted to accommodate a front grill 114. A conduit 116 having a discharge orifice 118 is mounted for swivel movement in the housing 110 so as to enable the discharge orifice 118 to traverse a path defining an essentially planar travel area oriented substantially parallel to the grill 114. The conduit will be caused to swivel by reaction forces produced by a water stream discharged from the orifice 118.

FIG. 2 depicts the hydrotherapy apparatus 100 in use in a typical spa installation wherein the water tub 108 is shaped to define, for example, a bench 122 upon which a user 109 can comfortably sit with the major portion of his body below the upper surface 126 of a water pool 128. The water tub peripheral wall 106 preferably has one or more flat portions 132 through which the wall opening 104 is formed. The apparatus 100 is intended to be mounted in the opening 104 with the housing 110 projecting rearwardly from the flat wall portion 132 and with the housing frame 112 sealed against the front surface of the flat wall portion 132.

The general function of the apparatus 100 is to provide a pleasing massaging effect on the body of the user 109 without requiring that the user move his body relative to a fixedly positioned jet, as is customary in conventional spa installations. In order to achieve this effect, the conduit 116 is mounted so as to discharge a water stream from said discharge orifice 118 while concurrently causing the orifice to travel along the path defining said planar travel area. The discharge stream thus sweeps across and impacts against a two dimensional area of the users body. In accordance with a first embodiment of the invention (FIGS. 4 and 11), the discharge orifice 118 describes a path comprised of successive substantially semicircular path segments linked by translational path segments. In accordance with second (FIGS. 12–15) and third (FIGS. 16–18) embodiments of the invention, the discharge orifice path is comprised of successive substantially circular path segments linked by short translational path segments. FIGS. 5–10 which primarily illustrate structural details of the conduit subassembly, are common to all three embodiments. As will be seen hereinafter, the first, second, and third embodiments differ only in the structural configuration of the front grill 114 and more particularly the thrust modifier frame (134 in FIG. 1) portion thereof.

Although the particular dimensions of apparatus 100 may vary considerably, in a typical embodiment it is contemplated that the housing 110 fit within a six inch diameter wall opening 104 and that the discharge orifice traverse a path comprised of circular (or semicircular) path segments of about two inch diameter. The path preferably defines a circular travel area having a diameter of about five inches. Embodiments having differently shaped and dimensioned travel areas are readily attainable but in any event, it is preferable that the perpendicular dimensions of the travel area have a ratio no greater than 4:1.

Attention is now directed to FIGS. 4–11 which illustrate the structural details of a first embodiment of the present invention. Specifically, attention is initially directed to FIG. 4 which shows the housing 110 mounted within opening 104 of wall 106. The housing 110 is comprised of a wall 140 defining a tapered cylindrical portion 142. The front end of wall 140 terminates in the outwardly extending open frame 112 comprised of section 146 and 148 connected by shoulder 150. Shoulder 150 is intended to engage the edge of the tub peripheral wall 106 in the opening 104. Frame section 148 is intended to seal against the front surface of peripheral wall 106.

The cylindrical wall 140 blends into radially extending rear wall 156 which extends to wall 158 defining a short axially extending pipe section. The housing wall further defines a water supply pipe 162 and an air supply pipe 164. The water supply pipe 162 has an open end 166 intended to be connected to a source of pressurized water, such as electrically powered pump 168 of FIG. 3. The inner end of pipe 162 communicates with a nozzle insert 170 mounted to discharge a water jet along the axis of the aforementioned pipe section 158. The open end 172 of air pipe 164 can be left open to the ambient air or can be connected to the discharge side of an optional electrically powered blower 174, depicted in FIG. 3.

The apparatus 100 includes a conduit subassembly 180 (FIGS. 7–9) intended to be mounted in the housing 110. The conduit subassembly 180 is comprised of an elongated rigid conduit 116 shaped to essentially define a tubular supply section 186 having a supply orifice 188, a tubular discharge section 190 having said discharge orifice 118 and a tubular intermediate section 194 coupling said supply section to said discharge section. The outer wall surface 198 of the supply section 186 is spherically shaped to essentially define a ball 199 intended to be mounted for swivel movement within a socket member 200.

The socket member 200 comprises an essentially cylindrical member having a radially extending flange 202 which is mounted against the inner surface of the housing rear wall portion 156. The socket member 200 includes a cylindrical wall portion 210 which extends rearwardly from the flange 202 and is located substantially axially in the pipe section 158. An O-ring 212 is mounted on the exterior surface of the wall portion 210 for sealing against the interior surface of the pipe section 158. The socket member 200 has a radially inwardly extending lip 218 at its forward end surrounding an opening 220. An O-ring 224 is mounted on the interior surface of the lip 218 around the opening 220 and is intended to engage the outer spherical surface 198 of said supply section ball 199.

A ring 228 (FIG. 10) is mounted at the rear end of cylindrical wall 210 and internally accommodates an O-ring 230. The spaced O-rings 224 and 230, together with wall portion 210, define a socket 232 within which said conduit ball 199 can swivel. The ball and socket mounting defines an essentially universal joint enabling the ball 199 to rotate around the axis defined by nozzle 170 and also around first and second (e.g. vertical and horizontal) axes perpendicular to the nozzle axis.

FIGS. 4 and 7–9 illustrate a preferred conduit geometry in which the axis of the tubular intermediate section 194 deviates by an acute angle, e.g. 24°, from the axis of the tubular supply section 186 and the axis of the discharge section 190 deviates by an acute angle, e.g. 24°, from the plane defined by the axes of the supply and intermediate sections. The sections are preferably curved so as to blend smoothly into one another. Moreover, in order to develop maximum translational thrust on the discharge end of the conduit 116 the axis of the intermediate section 194 extends along a line displaced from the center of rotation of ball 199 within socket 232. As will be seen, the center of rotation can move axially through a limited distance but will always lie along the axis of nozzle 170. This displacement between the intermediate section axis and the center of rotation produces an enhanced turning moment for translating the discharge end of conduit 116.

Figure 8:
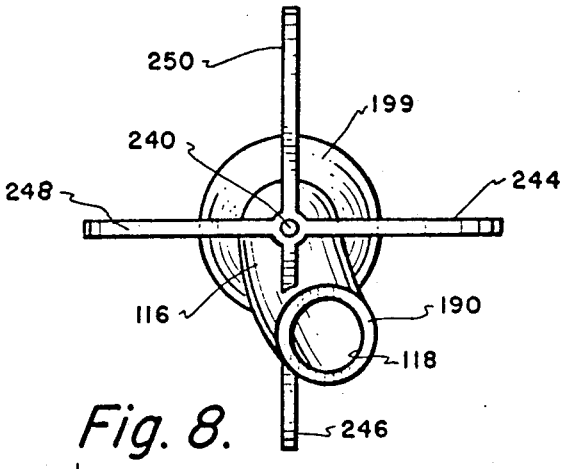
FIG. 8 is a front view of the conduit subassembly of FIG. 7.
Figure 9:
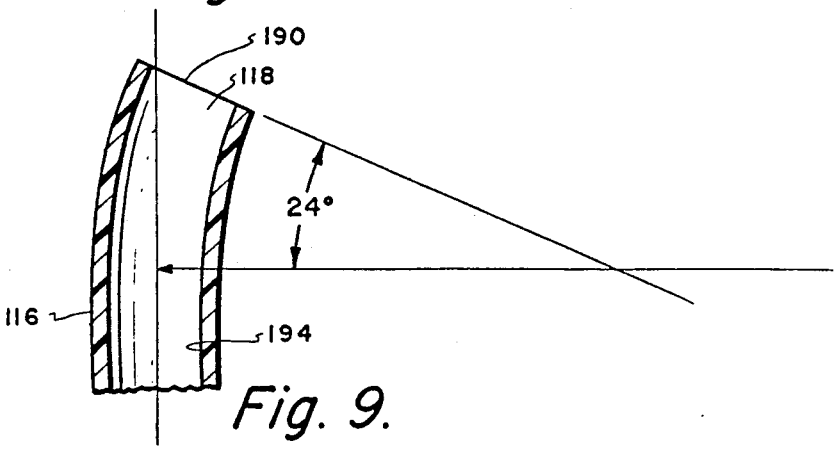
FIG. 9 is a sectional view taken substantially along the plane 9—9 of FIG. 7.
Figure 10:
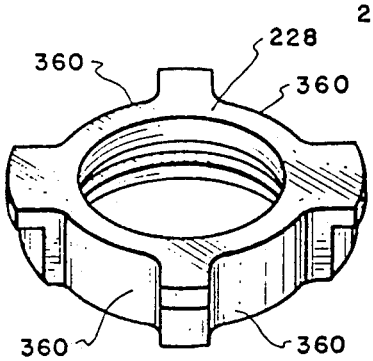
FIG. 10 is an isometric view of the mounting means near ring shown in FIGS. 4 and 6.

The conduit subassembly 180 includes a forwardly projection pivot pin 240 which is mounted substantially along a projection of the conduit supply section 186 axis. A plurality of drag plates 244, 246, 248, and 250 extend outwardly from the conduit 116 in cruciform fashion with respect to pin 240 as is best depicted in FIG. 8.

Figure 11:
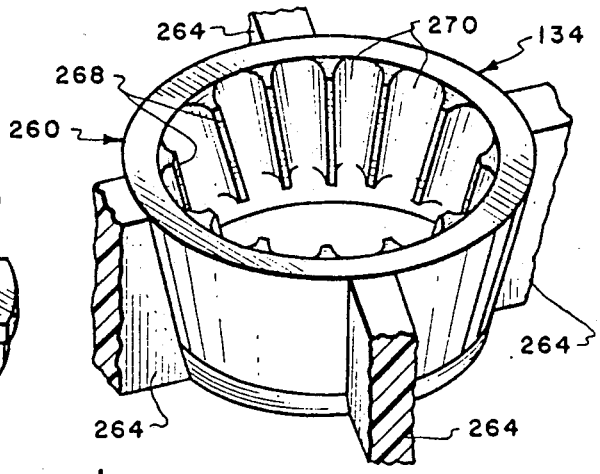
FIG. 11 is an isometric view, partially broken away, of the thrust modifier frame depicted in FIGS. 1 and 4.
Figure 12:
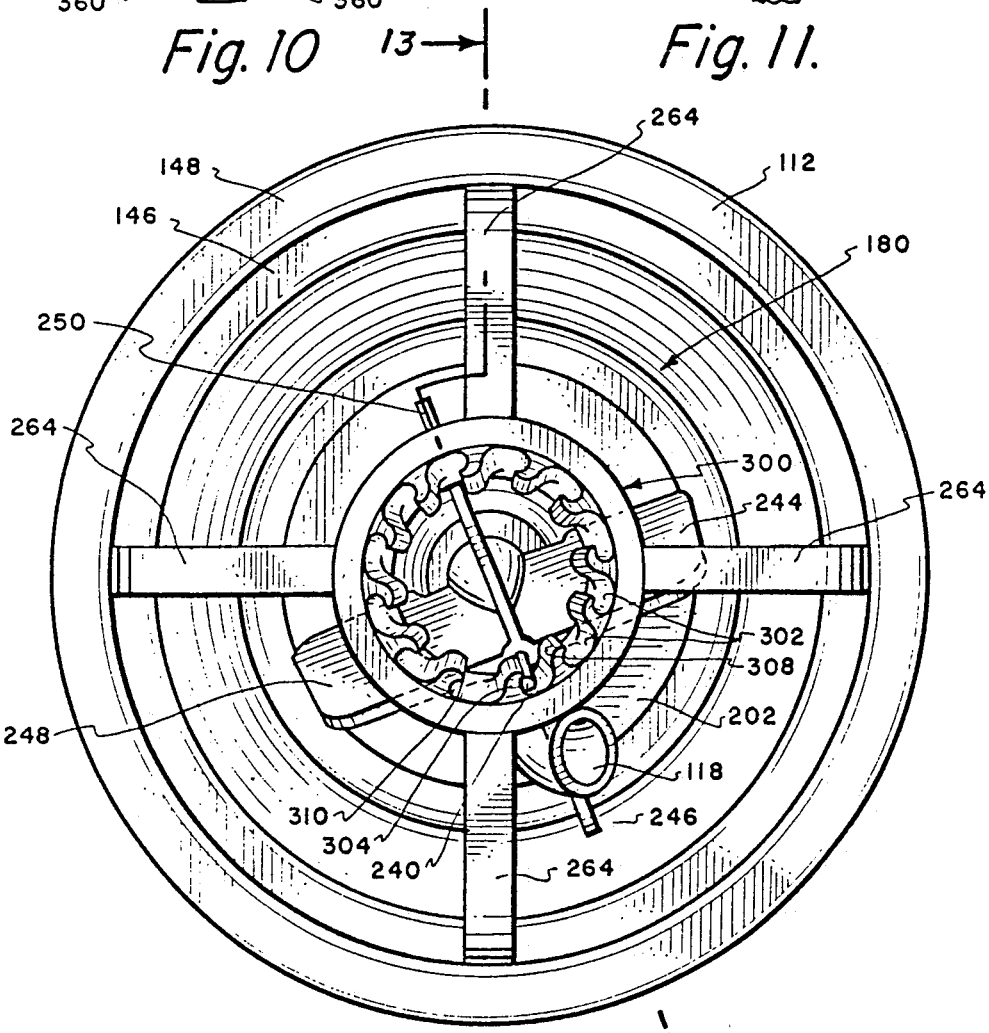
FIG. 12 is a front plan view of a front grill incorporating an alternative thrust modifier frame in accordance with a second embodiment of the invention.
Figure 13:
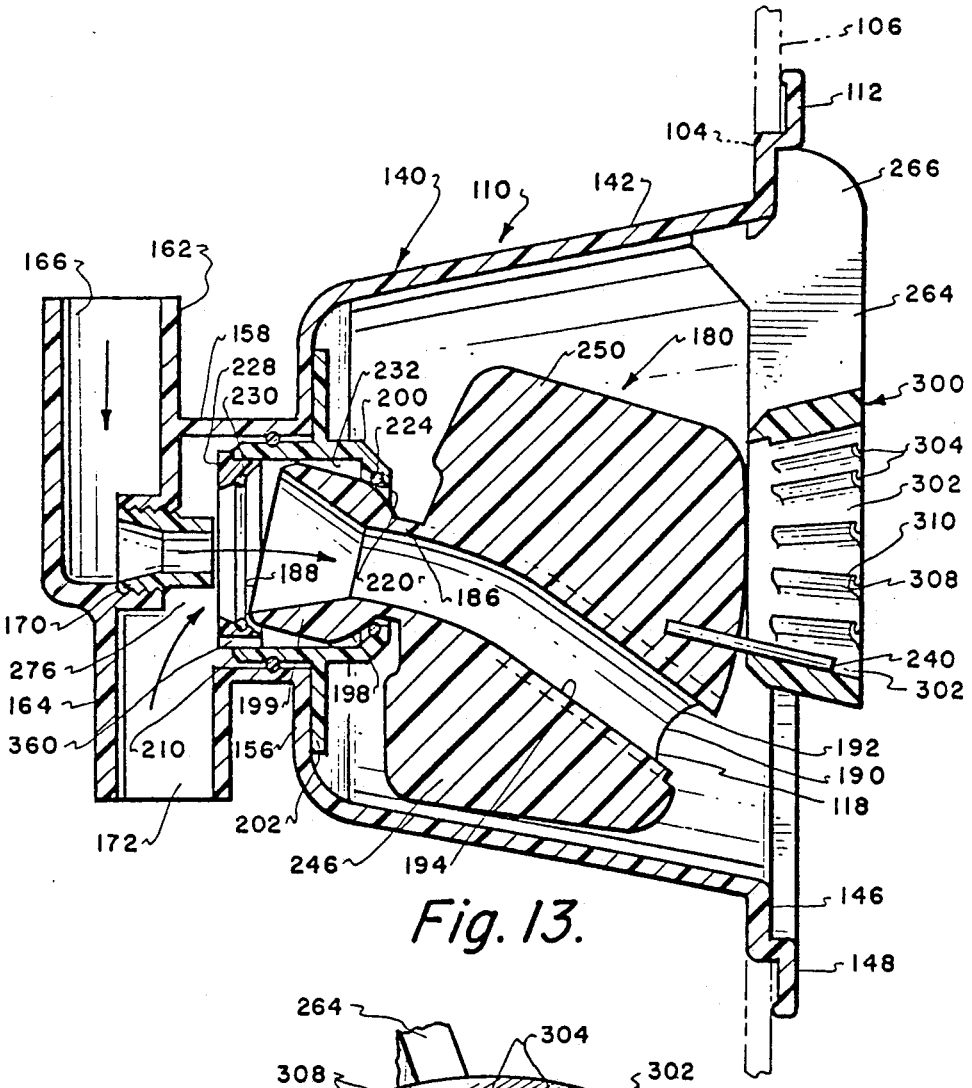
FIG. 13 is a sectional view taken substantially along the plane 13—13 of FIG. 12.
Figure 14:
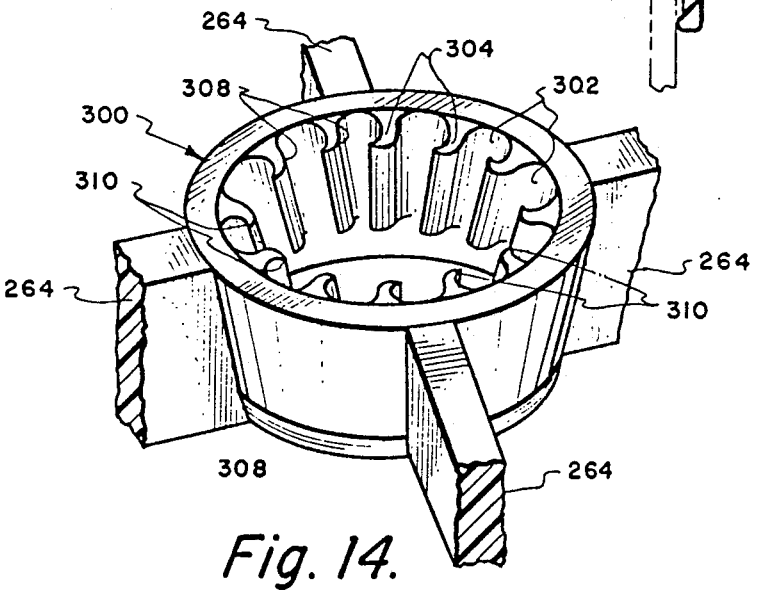
FIG. 14 is an isometric view, partially broken away, depicting the thrust modifier frame of FIG. 12.

The pivot pin 240 extends into the central area 252 of thrust modifier frame 134, best depicted in FIGS. 1, 4, and 11. The thrust modifier frame 134 comprises part of the aforementioned front grill 114 which additionally includes radially extending arms 264. The arms 264 terminate at their free ends in perpendicularly extending portions 266 and 268. As is best depicted in FIG. 4, when the grill 114 is installed within the housing frame 112, arm portion 266 bears against the front surface of frame section 146 while portion 268 bears against the inner surface of housing wall 140. By proper choice of materials and close dimensioning, the grill 114 will be held in place and yet can be readily manually inserted into and removed from the housing 110 to provide access to the interior of the housing.

With the front grill 114 mounted on the housing 110 as depicted in FIG. 4, the thrust modifier frame 134 will be substantially axially aligned with the axis of jet nozzle 170.

The thrust modifier frame 134 comprises a ring 260 having an inner surface including a plurality of symmetrically shaped radially inwardly extending spaced projections 268 defining U-shaped recesses 270 opening toward the center of the ring 260. Each of the recesses 270 is dimensioned so as to readily axially accommodate the pivot pin 240. With the pivot pin 240 accommodated in a frame recess 270, the pin 240 will extend along a line deviating by an acute angle, e.g. 13°, (FIG. 7) from an extension of the jet nozzle 170 axis.

In the operation of the apparatus 100 as thus far described, consider now that pressurized water is supplied from pump 168 via pipe 162 to the nozzle 170. The nozzle 170 will discharge a water jet into a suction cavity 276 (FIG. 4) essentially defined by pipe section wall 158, rear ring 228, and tapered supply orifice 188 to the supply section 186. The water jet discharged at high velocity into this suction cavity 276 creates a suction which acts to draw air, via air pipe 164, into the cavity 276 for entrainment by the water jet. The resulting water-air stream then flows through conduit 116 thrusting the ball surface 198 forwardly against the O-ring 224. The stream will then be discharged through discharge orifice 118 below the upper surface 126 of water pool 128 in a direction having a primary component extending substantially along the conduit elongation for massaging user 109 and a secondary component substantially perpendicular thereto for producing a reaction force which acts on the free discharge end of the conduit 116 to produce both rotational and translational thrust. More specifically, primarily as a consequence of the deviation of the intermediate section 194 axis from the supply section 186 axis, a translational thrust will be produced acting to swivel the ball 199 and translate the discharge end of conduit 116, i.e. orifice 118. Translation of the discharge orifice 118 of course also translates the pivot pin 240 enabling it to move randomly within the confines of thrust modifier frame 134. In addition to the translational thrust produced on the discharge end of the conduit 116, the conduit discharge end is also rotated around the axis defined by nozzle 170, primarily attributable to the deviation between the axis of the conduit discharge section 190 and the plane defined by the axes of conduit sections 186 and 194. The drag plates 244–250 prevent the conduit from rotating too fast.

As a consequence of these reaction forces acting on the discharge end of the conduit 116, the pivot pin 240 will move across the open area 252 defined by thrust modifier ring 260, traversing from one recess 270 to another in a seemingly random unpredictable pattern. That is, after the pin 240 translates across the open area defined by ring 260, it will enter a recess 270 and engage the ring 260 so that the rotational thrust on the conduit discharge end will rotate the discharge end around the pin 240 through a substantially semicircular arc until the discharge orifice 118 moves to an orientation enabling the translational thrust to cause the pin 240 to escape from its recess. The pin will then translate across the ring open area 252 to an opposite recess. Thus, the path described by the discharge orifice 118 will essentially be comprised of a series of semicircular path segments linked by translational path segments. As a consequence of considerable experimentation, using embodiments of the thrust modifier ring similar to that depicted in FIGS. 1, 4 and 11, it has been found that the precise path described by pin 240 and discharge orifice 118 cannot be accurately predicted. More specifically, in actual development embodiments, the pin 240 was found to move essentially randomly from one recess to another, sometimes skipping only one or two recesses and sometimes skipping a much larger number of recesses. In all instances, however, the discharge orifice path was comprised of essentially semicircular path segments linked by translational path segments. The inherent randomness or unpredictability of the discharge orifice path using the thrust modifier frame of FIGS. 1, 4, and 11, has been found to produce an interesting and pleasing massaging effect upon the user. It is not entirely clear, however, whether users prefer such unpredictable randomness or a similar but more predictable discharge orifice path which can be achieved by certain structural modifications as are depicted in applicants, second embodiment shown in FIGS. 12–15.

Attention is now directed to FIGS. 12–15 which depict an embodiment which differs from the previously discussed embodiment only in the structural configuration of the thrust modifier ring portion of the front grill. That is, whereas the ring 260 of FIG. 11 included symmetrically shaped radially inwardly extending spaced projections 268 defining U-shaped recesses 270 opening toward the center of the ring 260, the thrust modifier ring 300 on front grill 301 of FIGS. 12–15 includes recesses 302 which open both toward the center of the ring and toward an adjacent recess. More specifically, with particular reference to FIGS. 12 and 14, note that a plurality of spaced identical projections 304 are formed on the inner circumferential surface of ring 300. A recess 302 is formed between each adjacent pair of projections 304.

Each projection 304 defines a smoothly curved edge 308 which comprises the exit or right side edge of a recess 302 along which the pivot pin 240 tends to travel in escaping from a recess. Each projection further includes a hook portion 310 which lies over the left side edge of a recess 302. The particular geometry of the thrust modifier ring 300 depicted in FIGS. 12–15 tends to cause the pivot pin 240 to precess along a path in which it enters each of the recesses 302 and while in each recess rotates through a substantially full 360° circle prior to exiting for the immediately adjacent recess in a counter clockwise direction around ring 300.

In order to better understand the operation of the embodiment of FIGS. 12–15, attention is directed to FIG. 15 which in five successive snap shot views shows how the pivot pin 240 escapes from a recess 302 and translates to the next recess moving around ring 300 in a counter clockwise direction while rotating in a clockwise direction. To lend clarity to the movement of the pin 240 and the path of movement of the discharge orifice 118, a force arrow 320 is depicted in FIG. 15 showing the primary direction of the translational thrust on the conduit discharge end for the various orientations of the conduit. That is, as has been previously mentioned, the translational thrust is primarily attributable to the deviation between the axes of the conduit supply and intermediate sections and acts in a radial direction substantially along drag plate 250. The various orientational views of FIG. 15 also show force arrows 322 and 324 which depict the rotational thrust tending to rotate the conduit in a clockwise direction around the axis of nozzle 170. Although the rotational thrust is actually produced as a reaction to the stream discharged from orifice 118, for simplicity in FIG. 15 it is shown as acting on drag plates 244 and 248.

Figure 15A:
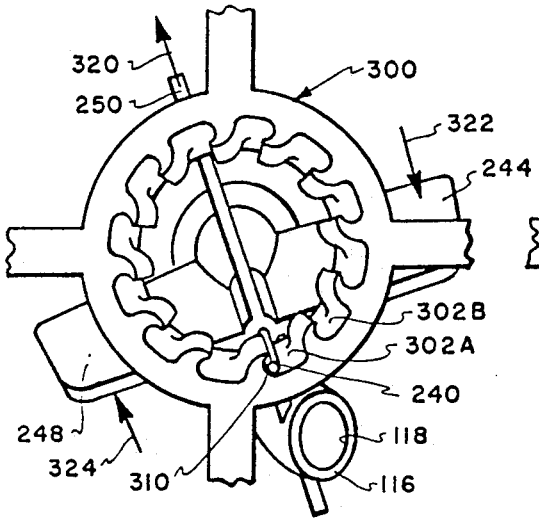
FIGS. 15*a* through 15*e* are schematic frontal views of the embodiment of FIG. 12 showing the motion of the conduit subassembly discharge orifice.
Figure 15B:
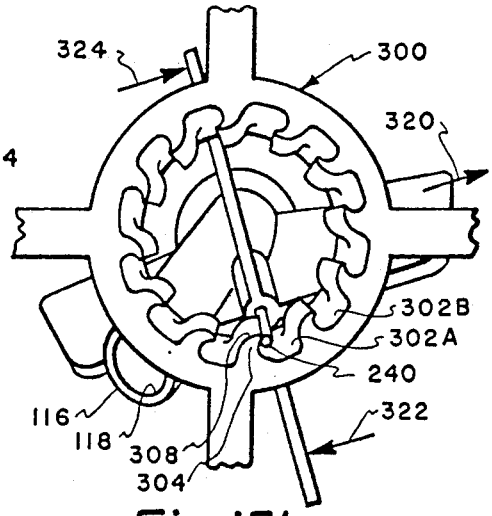
Figure 15C:
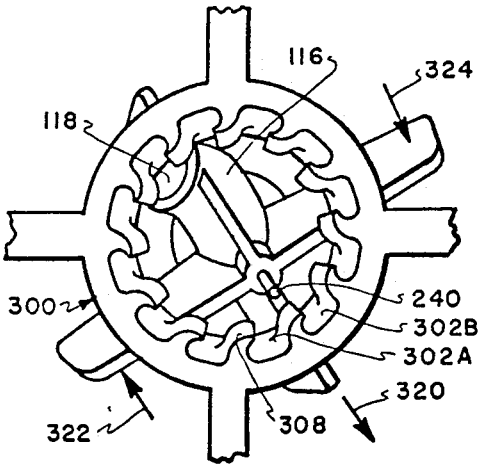
Figure 15D:
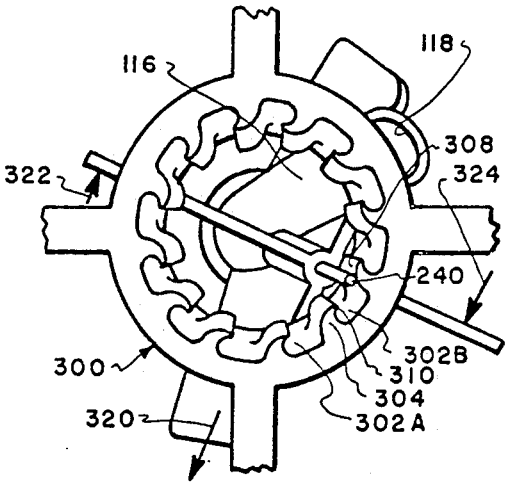
Figure 15E:
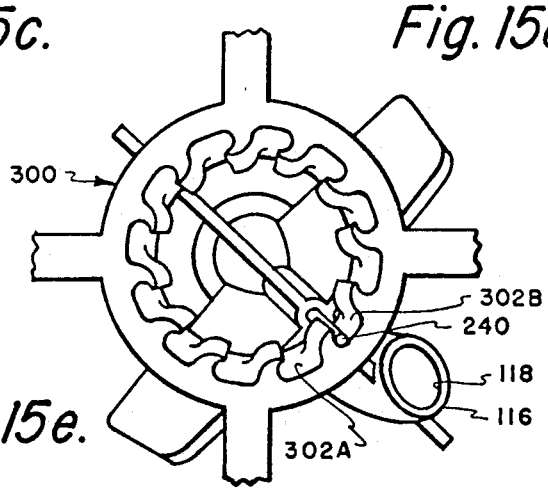

With the foregoing considerations in mind, now consider the orientation of the conduit 116 in FIG. 15*a* wherein the discharge orifice is located at approximately a five o'clock position. With the translational force acting in the direction of arrow 320, the pin 240 will be retained in recess 302A by engaging the overlying hook 310. The rotational force represented by arrows 322 and 324 will rotate the conduit 116 to move the discharge orifice 118 in a clockwise direction toward the seven o'clock orientation depicted in FIG. 15*b*. Note that when in the orientation of FIG. 15*b*, translational force arrow 320 is now acting in a direction tending to move pin 240 out of the recess 302A essentially along exit edge 308 of the projection 304. The rotational force arrows 322 and 324 continue to act to rotate the conduit 116 clockwise. The forces depicted in FIG. 15*b* will move the discharge orifice 118 to the ten o'clock position depicted in FIG. 15*c* which shows the pin 240 having escaped from the recess 302A. When in this position however note that the translational force arrow 320 is acting in a direction tending to move the pin to the immediately adjacent recess 302B in a counterclockwise direction around ring 300. The rotational thrust will continue to rotate the conduit clockwise moving the discharge orifice to the one o'clock position depicted in FIG. 15*d* whereat the pin 240 begins to enter the recess 302B. The translational and rotational forces then move the pin fully into the recess 302B below the hook portion 310 of the projection 304. Thus the view in FIG. 15*e* is substantially identical to that in FIG. 15*a* except that the pivot pin 240 has advanced in a counterclockwise direction along ring 300 from recess 302A to recess 302B. In the course of advancing one recess, the discharge orifice 118 has described a circular path segment. Thus, as the pivot pin 240 precesses around the thrust modifier ring 300 in a counterclockwise direction, the discharge orifice 118 will describe a path comprised of circular path segments linked by short translational path segments from recess to recess.

Although the aforedescribed first and second embodiments operate rather well under most circumstances, it has been observed that the movement of the discharge orifice 118 can become rather sluggish or even stop when the user leans back tightly against the front grill 114, 301. This is believed to be because the user's body effectively blocks the free flow of the discharge stream from the orifice 118 thus creating turbulence around, and back pressure within, the conduit 116 thereby reducing the energy available to move the conduit discharge section. The front grill embodiment of FIGS. 16–18 has been designed to avoid this potential problem.

Figure 16:
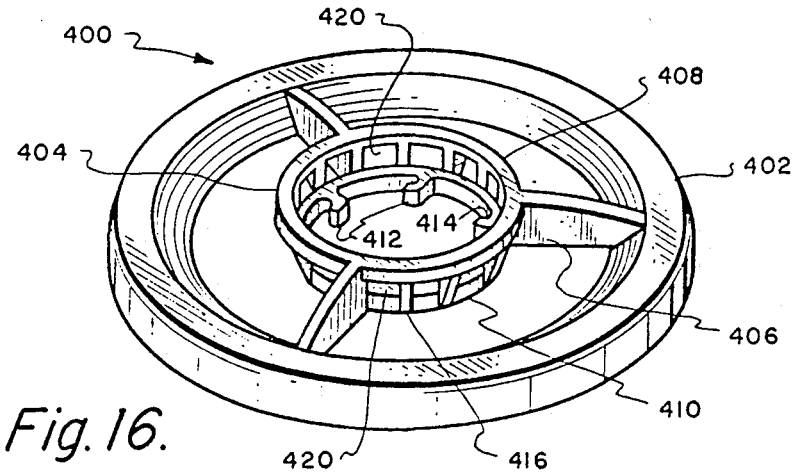
FIG. 16 is an isometric view of a front grill depicting a further alternative thrust modifier frame in accordance with the present invention.
Figure 17:
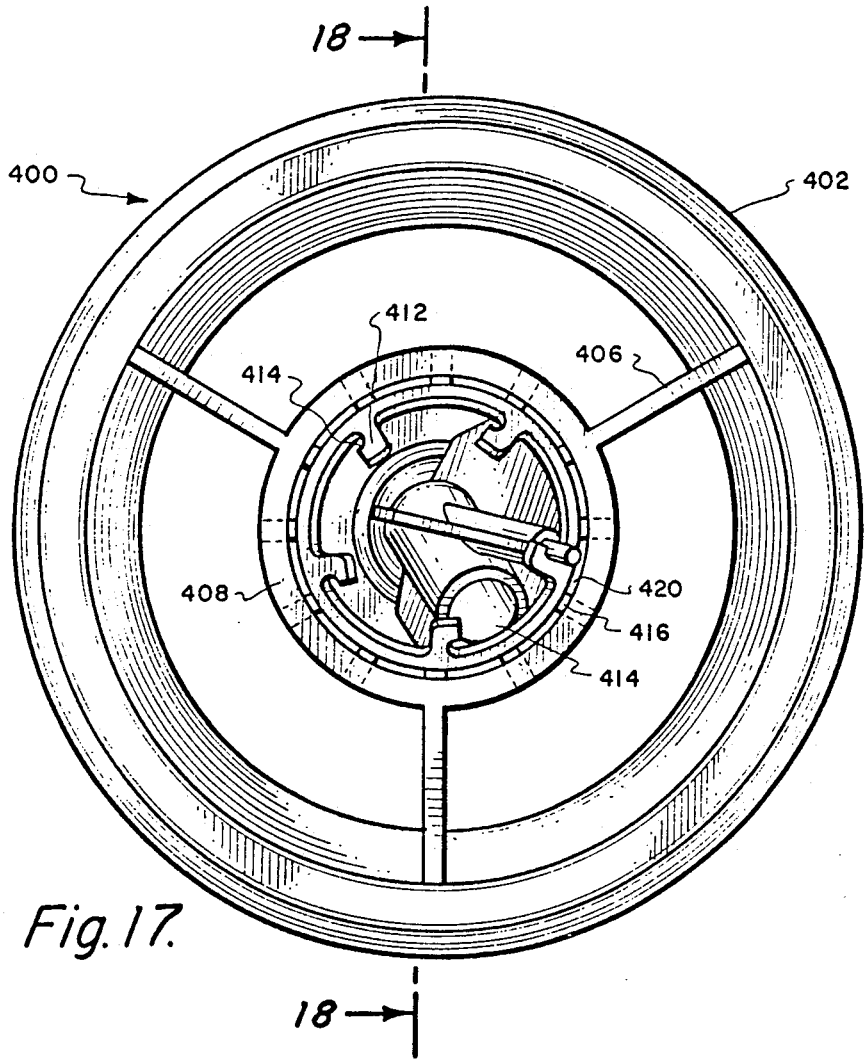
FIG. 17 is a front plan view of the thrust modifier frame of FIG. 16 mounted in front of the conduit discharge orifice.
Figure 18:
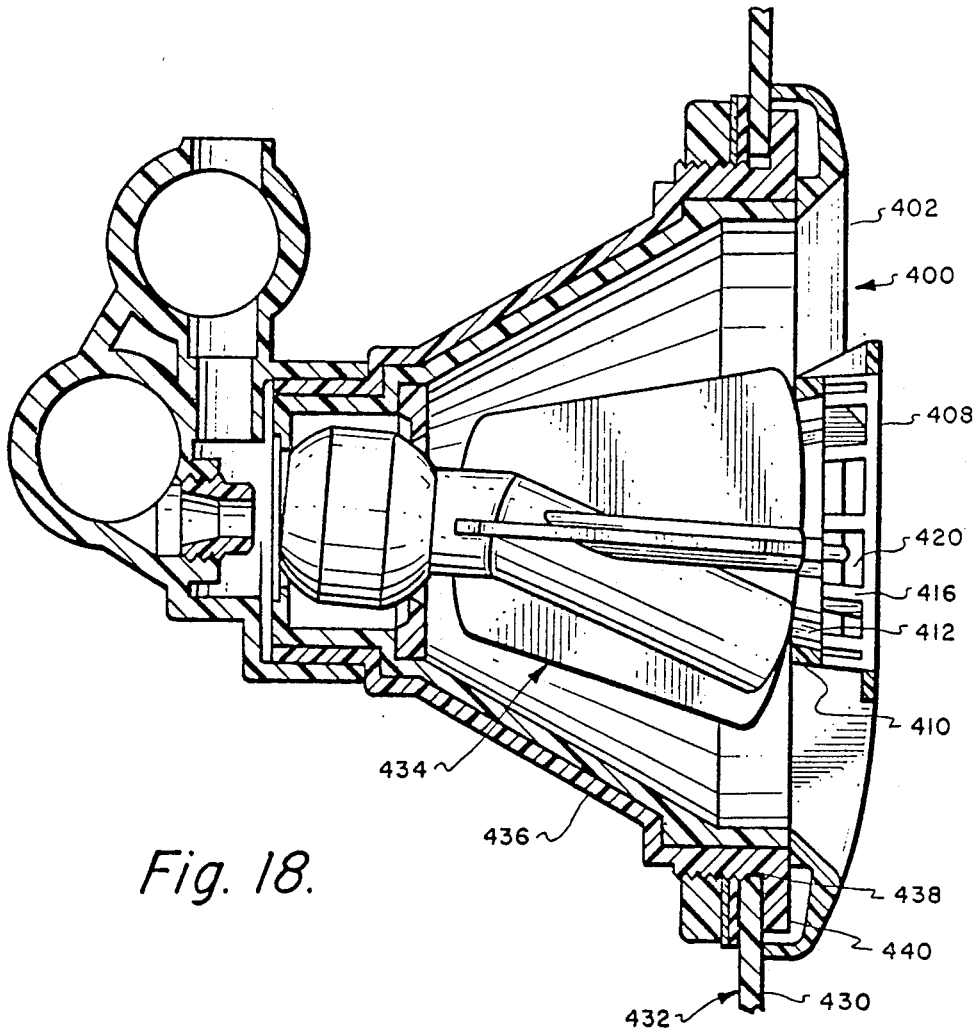
FIG. 18 is a side sectional view taken substantially along the plane 18—18 of FIG. 17.

More specifically, the front grill 400 of FIGS. 16–18 is comprised of an outer frame or ring 402 and a concentric inner frame or ring 404 spaced by radially extending arms 406. The inner ring 404 is configured to include axially spaced forward and rearward ring portions 408, 410 with the rearward portion 410 supporting inwardly extending projections 412 which are used to modify the thrust on the conduit discharge section, as previously discussed. The projections 412 are shaped to define undercut recesses 414 and are substantially identical to projections 304 and recesses 302 of the embodiment of FIGS. 12–15 and function in a substantially identical manner. The particular number of projections used on the thrust modifier ring is an arbitrary design parameter and it is noted that the ring 410 is depicted in FIGS. 16–18 as having fewer projections 412 than the ring 300 of FIGS. 12–15. The use of fewer projections 412 will, of course, have the effect of slightly lengthening the translational path segments linking the circular path segments described by the discharge orifice of FIGS. 16–18 as compared with the path described in FIGS. 12–15.

The forward portion 408 of inner ring 404 is axially spaced from the rearward portion 410 by a plurality of substantially parallel short ribs 416 which are spaced from one another around the circumference of the ring portions. Three of the ribs 416 are respectively defined by the radially inward edges of arms 406. The spacing between adjacent ribs 416 defines openings 420 which enable components of the discharge stream to flow radially in the event a user seals his body against the ring portion 408. By allowing the stream to escape in this manner, turbulence and back pressure buildup in and around the conduit, with attendant diminished discharge orifice motion, can be avoided. In order to even further avoid such diminished discharge orifice motion, note in FIG. 18 that the forward ring portion 408 extends axially forward of the outer ring 402 to thereby essentially prevent the user from sealing his body against the entire outer ring 402.

In use, the front grill 400 is mounted adjacent the inner surface 430 of tub wall 432 in front of the conduit subassembly 434, as depicted in FIG. 18. The conduit subassembly 434 is mounted within housing 436 which projects rearwardly through wall opening 438. Although various techniques could be employed for physically mounting the grill 400 in front of wall opening 438, it is preferred that the grill 400 be mounted to housing flange 440 by a bayonet-type coupling (not shown).

Figure 3:
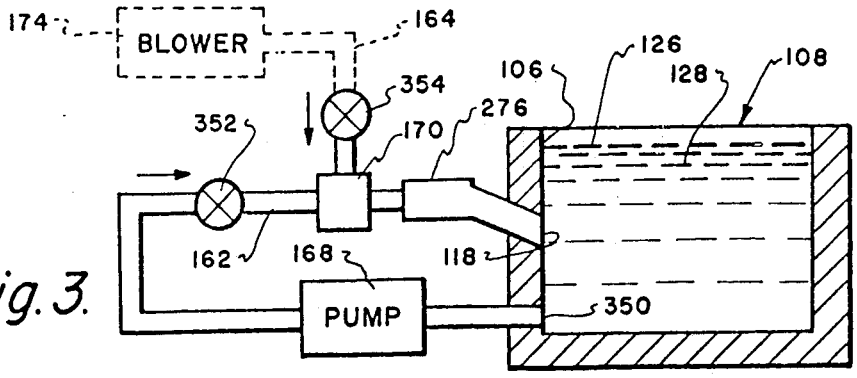
FIG. 3 is a schematic illustration depicting the manner in which an apparatus in accordance with the invention is plumbed in a typical installation.
Figure 7:
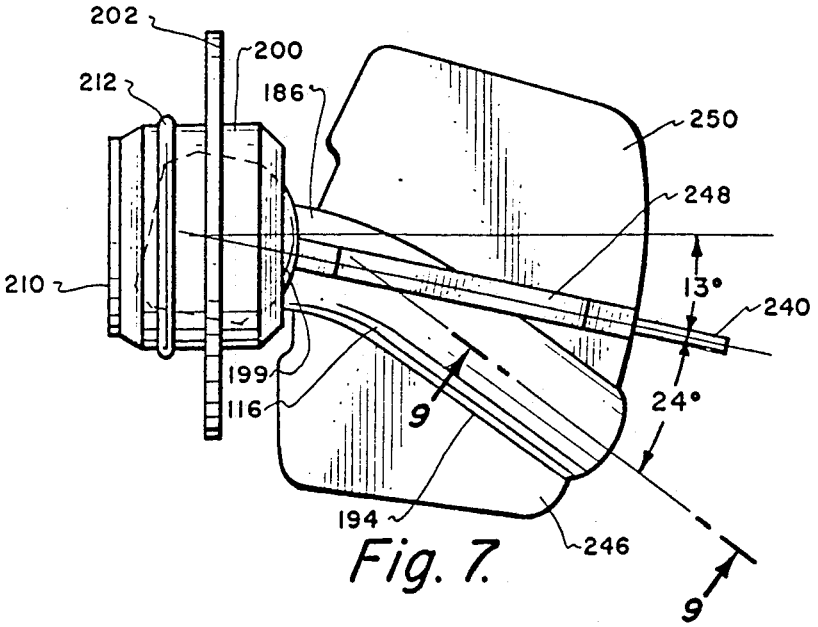
FIG. 7 is a side elevational view of a preferred conduit subassembly and mounting means in accordance with the present invention.

FIG. 3 schematically depicts a typical plumbing installation for embodiments of the present invention and includes an electric motor driven pump 168 which pulls water from tub 108 via port 350. The pump 168 then supplies a water stream through a manually variable valve 352 to the nozzle 170 discharging into suction cavity 276. Air is preferably supplied to the cavity 276 via the air pipe 164 and a manually variable valve 354. The inlet side of valve 354 can be open to the ambient air or can be coupled to the outlet of an optional motor driven blower 174.

It has been observed that when the air supply to the suction cavity 276 is cut off, either intentionally or inadvertently, the suction created by the water jet discharged from nozzle 170 acts on the conduit itself which in some configurations increases friction loss and results in sluggish swivel movement.

In order to avoid this friction build up and resulting sluggishness, embodiments in accordance with the present invention contemplate that the O-rings 224 and 230 be spaced sufficiently so that the ball 199 can exhibit limited axial movement in the socket 232. More specifically, note in FIG. 4 and in FIG. 13, that the ball 199 is thrust against the forward O-ring 224 as a consequence of the water-air stream entering the supply orifice 188. If the air supply through air pipe 164 is cut off, the resulting suction produced in cavity 276 will pull the ball 199 to the rearward position against O-ring 230 as depicted in FIG. 6. When the ball 199 is pulled rearwardly, it opens a passageway from the water pool 128 to the suction cavity 276 via opening 220 around the surface 198 of ball 199 and through slots 360 in rear ring 228. As a consequence, the suction created by the jet discharged from nozzle 170 will pull pool water into the suction cavity 276 and thereby relieve the rearward suction against the conduit itself and the resulting friction buildup. Instead, the suction will entrain the pool water sucked into the cavity 276 and discharge a water stream of lower velocity but greater mass as compared to a stream with entrained air.

Attention is now directed to FIGS. 19–25 which illustrate a fourth embodiment of the invention. Although this fourth embodiment is similar to that disclosed in FIG. 18, it has been specifically configured to enable a user to selectively operate it in an air entrainment mode and/or a water entrainment mode. In the air entrainment mode, air is drawn into the mixing chamber and entrained by the supplied water jet to discharge a water-air stream. In the water entrainment mode, tub water is drawn into the mixing chamber and entrained by the supplied water jet. In a fifth embodiment of the invention depicted in FIGS. 26–28, the user is not only able to select between an air entrainment mode and a water entrainment mode, but additionally is able to vary the amount of air and/or water which is entrained to thus vary the momentum (i.e. perceived intensity) of the stream discharged from the discharge orifice. Additionally, the embodiment of FIGS. 26–28 enables the user to vary the magnitude of the supplied water jet, also for the purpose of varying the intensity of the discharge stream.

The ability to operate in an air entrainment mode and/or a water entrainment mode as well as the ability to vary the amounts of entrained air and/or tub water and/or supplied water jet enables the user to tailor the massaging effect to his particular taste. For example, some users prefer operation in the air entrainment mode because it produces air bubbles. However, the introduction of air tends to cool the tub water, thus requiring more frequent heater intervention or the addition of hot water. On the other hand, operation in the tub water entrainment mode without air entrainment minimizes heat loss and generally reduces noise. Operation in either mode can produce a discharge stream of sufficient intensity to create the same pleasing massage effect.

With continuing reference to FIGS. 19–24, a travelling discharge hydrotherapy apparatus 500 is disclosed generally comprised of an aerator body 501, an outer housing 502, an inner housing 503, and a front grill 504. The apparatus 500 is intended to be mounted in an opening 505 behind the peripheral wall 506 of a water tub.

The housing 502 has a generally conical forward portion 510 and a cylindrical rearward portion 511. The conical portion 510 terminates at its forward end in circumferential flange 512. The rearward face 514 of flange 512 is intended to bear against the interior face of tub wall 506. The housing 502 includes an externally threaded collar 516 which extends rearwardly from the flange 512. A nut 518 is threaded on the collar 516 to sandwich a sealing gasket 520 against the rear face of tub wall 506 and retain the housing 502 behind the wall opening 505.

The aerator body 501 includes a water supply nipple 520 and an air supply nipple 522. That is, nipple 520 is intended to be coupled to a water supply manifold (not shown) which is supplied with water under pressure, e.g. tap water or water from an electrically driven pump in the manner depicted in FIG. 3. The air supply nipple 522 is likewise intended to be connected to an air supply manifold (not shown) which is supplied with air as depicted in FIG. 3.

The water supply nipple 520 opens via passage 524 to a nozzle 526. Thus, water supplied to the nipple 520 will flow via passage 524 to the nozzle inlet 528 to discharge a water jet at the nozzle outlet 530 into a mixing cavity or chamber 532. The air supply nipple 522 is coupled via air passage 534 and air port 535 to the mixing chamber 532. As will be discussed hereinafter, the embodiment of FIGS. 19–24 incorporates a valve means for controlling the air flow between port 535 and mixing chamber 532. As will also be discussed hereinafter, the embodiment of FIGS. 19–24 also incorporates valve means for controlling the flow of tub water from the pool, i.e. via interior space 542, into the chamber 532.

In the embodiment of FIGS. 19–24, the valve means for both the air entrainment passageway, incorporated between the port 535 and the chamber 532, and the tub water entrainment passageway, incorporated between the interior space 542 and the chamber 532, is formed by the specially configured inner housing 503. The inner housing 503 is basically comprised of a forwardly located conical portion 552, an intermediate ring 553, an intermediate cylindrical portion 554, and a rearwardly located cylindrical portion 556.

Figure 19:
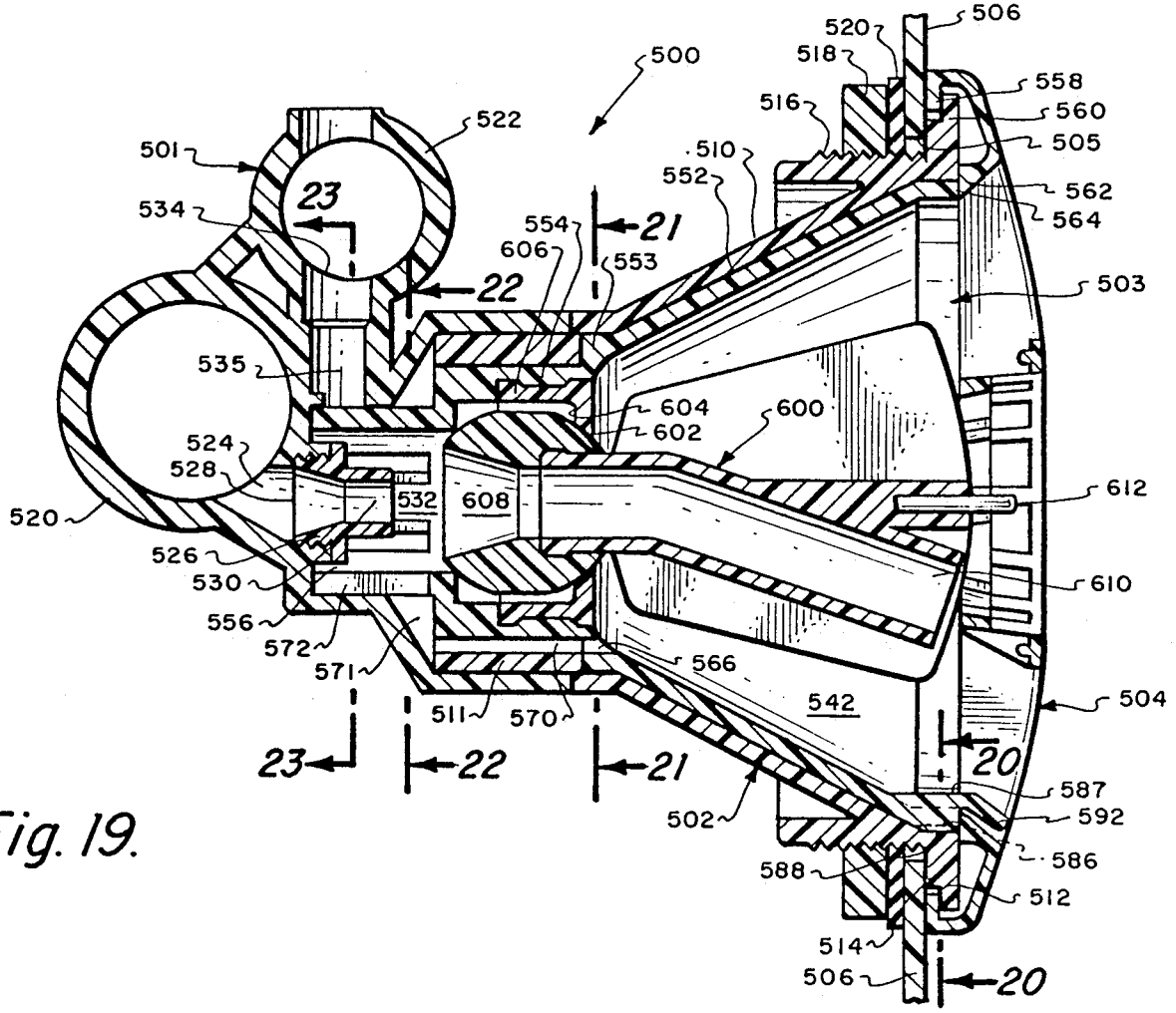
FIG. 19 is a sectional view of a fourth embodiment of the invention incorporating means for selectively adjusting the amount of air entrainment and water entrainment.
Figure 20:
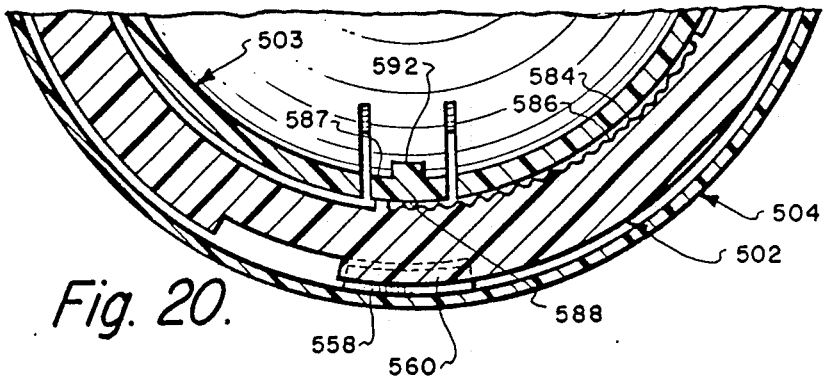
FIGS. 20, 21, 22 and 23 comprise sectional views taken respectively along the planes 20—20, 21—21, 22—22 and 23—23 of FIG. 19.
Figure 21:
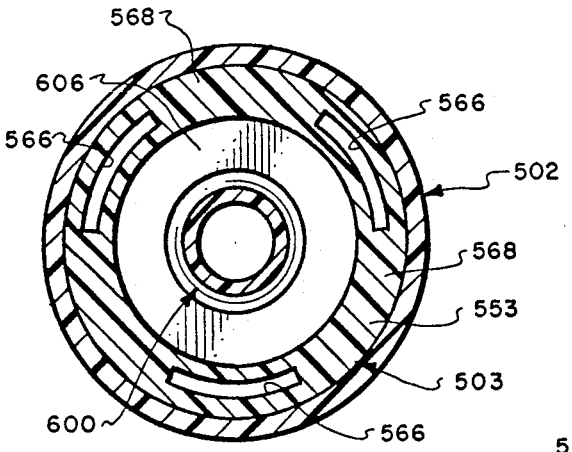
Figure 22:
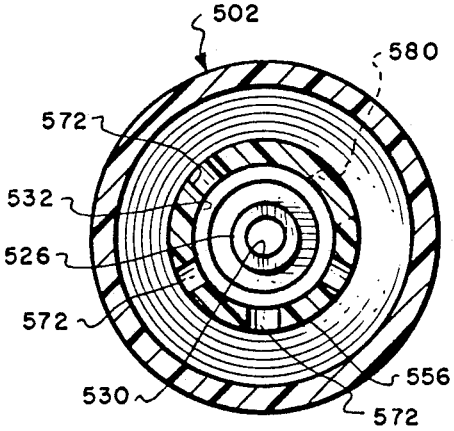
Figure 23:
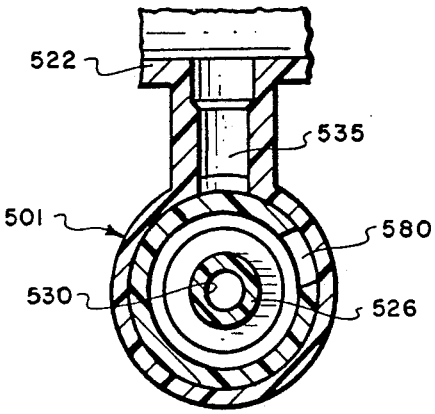
Figure 24:
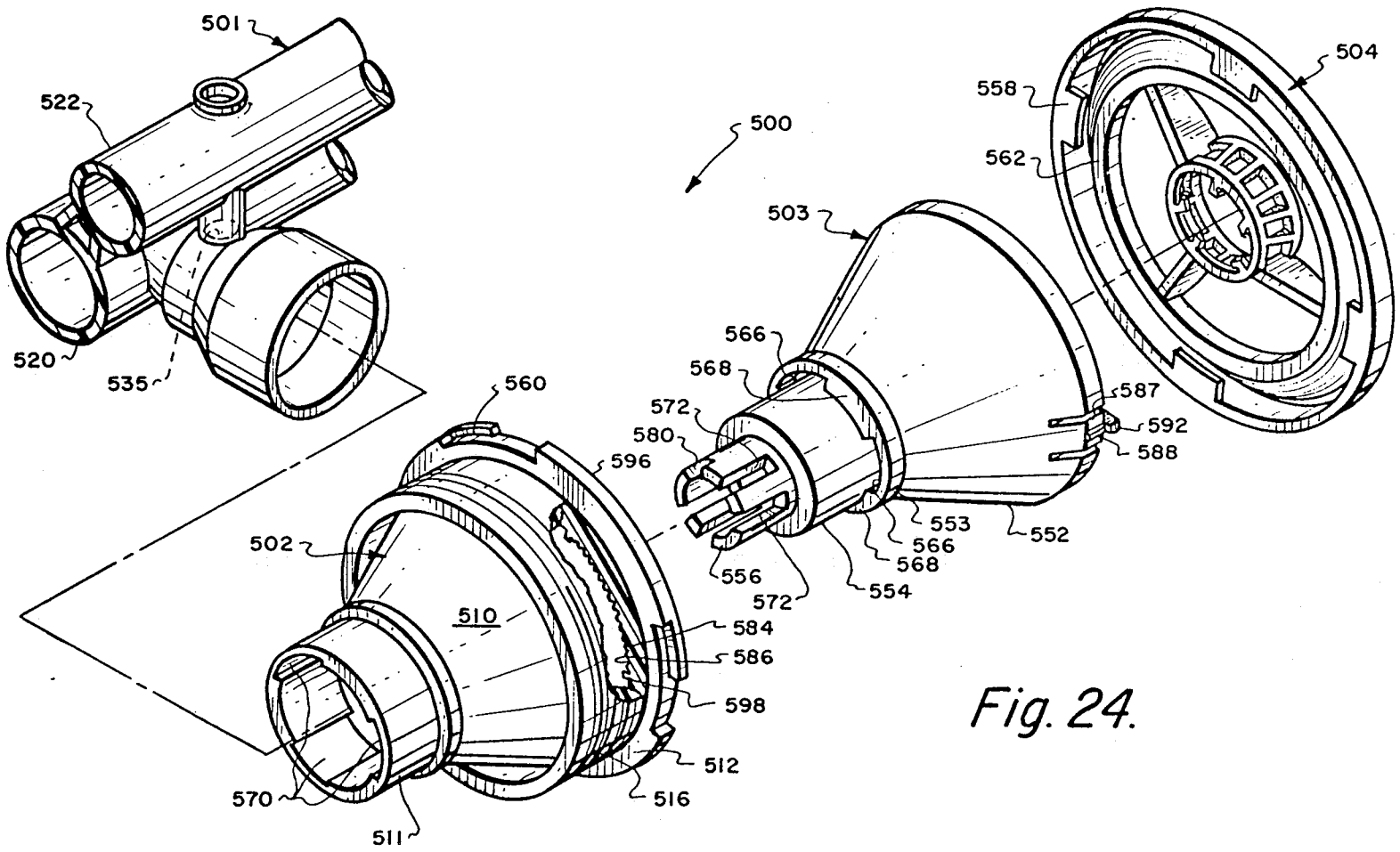
FIG. 24 is an exploded isometric view of the embodiment of FIG. 19.

As is depicted in FIG. 19, the inner housing 503 is intended to nest within the outer housing 502 with the inner housing conical portion 552 fitting within the outer housing conical portion 510. Similarly, the inner housing intermediate portion 554 fits within the outer housing cylindrical portion 511. The inner housing 503 is mounted so as to be able to rotate through a limited arc, e.g. 60° with respect to the fixedly mounted outer housing 502. The inner housing is retained within the outer housing 502 by the front grill 504, of the type previously discussed in connection with FIG. 18, which is fixed, as by a bayonet coupling 558, 560 to the outer housing flange 512 adjacent the tub peripheral wall 506. Note that the front grill 504 includes a ring 562 which is positioned immediately forward of the front edge 564 of the inner housing 503 to thus axially retain the inner housing within the outer housing 502.

The valve means for the tub water entrainment passageway, i.e. from interior space 542 to chamber 532, is formed by circumferentially spaced slots 566 in ring 553 which are separated by circumferentially spaced tabs 568. These slots 566 and tabs 568 cooperate with a water entrainment passageway formed by fixedly positioned axially extending circumferentially spaced slots 570 on the inner surface of outer housing cylindrical portion 511. That is, when an inner housing slot 566 is aligned with an outer housing slot 570, then tub water can pass from the interior space 542 through the slots 566, 570, then through the torsidal space 571 and the slots 572 in the inner housing cylindrical portion 556, into the mixing chamber 532. Thus, for a rotational position of the inner housing 503 such that a slot 566 is aligned with a slot 570, tub water will be pulled into the chamber 532 by the suction produced therein by the water jet discharged from nozzle 526. On the other hand, such tub water entrainment will be blocked by rotating the inner housing 503 to a position such that the tabs 568 are aligned with the water entrainment slots 570.

Rotation of the inner housing 503 also controls the valving of the air entrainment passageway from air port 535 to the mixing chamber 532. This action is controlled by an air slot 580 formed in the wall of inner housing cylindrical portion 556. That is, only when the air slot 580 is aligned with the air port 535 can air flow from the air supply nipple 522 to the mixing chamber 532.

In order to retain the inner housing 503 at a desired rotational position, the outer housing 502 is provided with a rack of teeth 584 defining shallow recesses 586 therebetween. The teeth 584 extend along an inner circumferential surface proximate to the forward end of the outer housing 502. The inner housing 503 is provided with a flexible finger 587 having a protuberance 588 which is dimensioned to be received within a recess 586. The finger 587 may be formed integral with the inner housing conical portion 552 but is characterized by being able to flex slightly with respect to the main body of conical portion 552. A lift tab 592 is formed on finger 587 for enabling a user to readily disengage the protuberance 588 from a recess 586. With the protuberance 588 thus disengaged, the user can rotate the inner housing 503 relative to the outer housing 502 to thus progressively vary the valve openings in the air entrainment and water entrainment passageways. By releasing the tab 592, the protuberance 588 can engage in a recess 586 to detent the inner housing 503 relative to outer housing 502. Note that the tooth rack 584 is provided with stops 596 and 598 which limit the angular rotation of the inner housing 503. In the embodiment illustrated in FIGS. 19–24, it is intended that the inner housing can be rotated through a total of 60 degrees to vary both air entrainment and water entrainment.

Figure 25A:
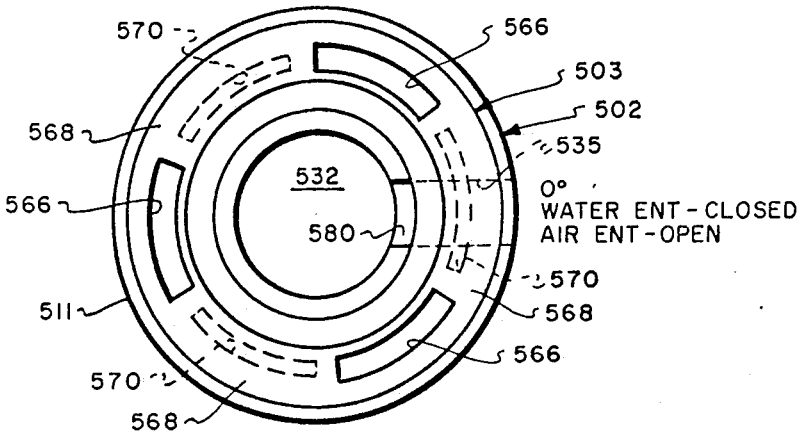
FIGS. 25*a*, 25*b*, 25*c* are schematic representations showing the valve orientations for water entrainment and air entrainment for various degrees of rotation of the control member of the third embodiment depicted in FIGS. 19–24.
Figure 25B:
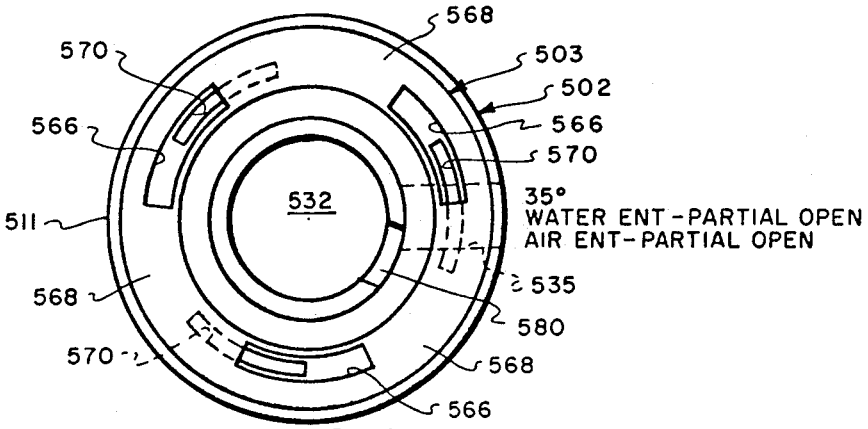
Figure 25C:
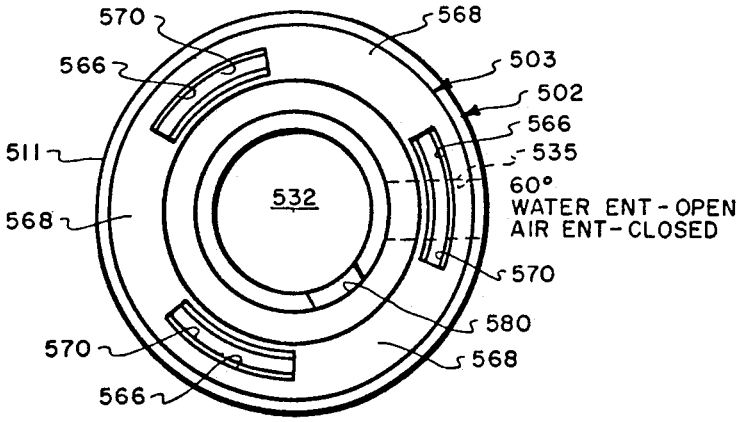

Attention is now directed to the following table and FIGS. 25*a*, 25*b*, and 25*c* which depict the operation of the embodiment of FIGS. 19–25 for various angles of rotation of the inner housing 503.

TABLE I

| | Rotation Angle | Water Entrain | Water Supply | Air Entrain | Discharge Momentum |
|---|---|---|---|---|---|
| AIR ENTRAIN. MODE | 0° (stop) | CLOSED | OPEN | OPEN | +4 |
| | 35° | PARTIAL | OPEN | PARTIAL | +4 |
| WATER ENTRAIN. MODE | 60° (STOP) | OPEN | OPEN | CLOSED | +4 |

An arbitrary scale (0–4) has been used in Table I to represent the relative magnitude of the discharge stream momentum.

Note that at the arbitrarily defined zero degree rotational position (FIG. 25*a*), the air entrainment path from air port 535 through air slot 580 to chamber 532 is open and the water entrainment path is closed as a consequence of tabs 568 blocking the water entrainment passageway slots 570.

FIG. 25*b* shows the valve configuration after the inner housing 503 has been rotated clockwise through 35°. Note that at this position, the air entrainment path is now only partially open as the air slot 580 has moved partially out of alignment with the air port 532. Note also that at this 35° rotational position, the water entrainment path has become partially open as the slots 566 on the inner housing 503 have moved into partial alignment with the fixed slots 570 on the outer housing portion 511.

FIG. 25*c* shows the valve configuration at a 60° rotational position whereat the water entrainment path is entirely open and the air entrainment path is entirely closed.

The remaining structural aspects of the apparatus 500 of FIGS. 19–25 are similar to those discussed in connection with the prior embodiments. Thus, apparatus 500 additionally includes a conduit 600 having an exterior ball surface 602 formed on one end thereof. The ball surface is mounted for swivel movement within a socket 604 defined by the interior surface of the inner housing cylindrical portion 554 and by a thrust nut 606. In contrast to the embodiment depicted in FIGS. 4 and 6 wherein the ball was permitted to move axially to open a passageway for tub water entrainment, in the embodiment of FIGS. 19–25, the ball 602 need not be mounted for axial movement because tub water entrainment is permitted, as has been previously discussed, via the slots 566 and 570. The ball 602 is mounted within the socket 604 so as to substantially align the conduit supply orifice 608 with the discharge axis of nozzle outlet 530. The conduit 600 is shaped substantially identically to that previously described in FIGS. 7, 8, 9, having a supply section, an intermediate section, and a discharge section, terminating in a discharge orifice 610. Also, as previously described, the conduit 600 has a pivot pin 612 projecting forwardly therefrom substantially aligned with the axis of nozzle 526. In operation, the stream discharged from orifice 610 will have a primary massage component extending substantially parallel to the elongation of the conduit 600. Additionally, however, the direction of the stream discharge will have a lateral component for producing a thrust force on the discharge end of the conduit 600 to cause the discharge orifice to traverse a substantially random path as the pin 612 moves from recess to recess within the front grill 504. The movement of the conduit 600 of FIGS. 19–24 is the same as is depicted in FIGS. 15*a*–15*e*.

In use, the apparatus 500 of FIGS. 19–25 will operate in the same manner as was previously described for the prior embodiments. However, with the apparatus 500, the user will be able to select whether the apparatus is to operate in the air entrainment mode or the water entrainment mode. An exemplary embodiment of the apparatus 500 is dimensioned such that the discharge stream, for any rotational angle of the inner housing, has an essentially constant discharge momentum, as indicated in the foregoing table I.

Figure 26:
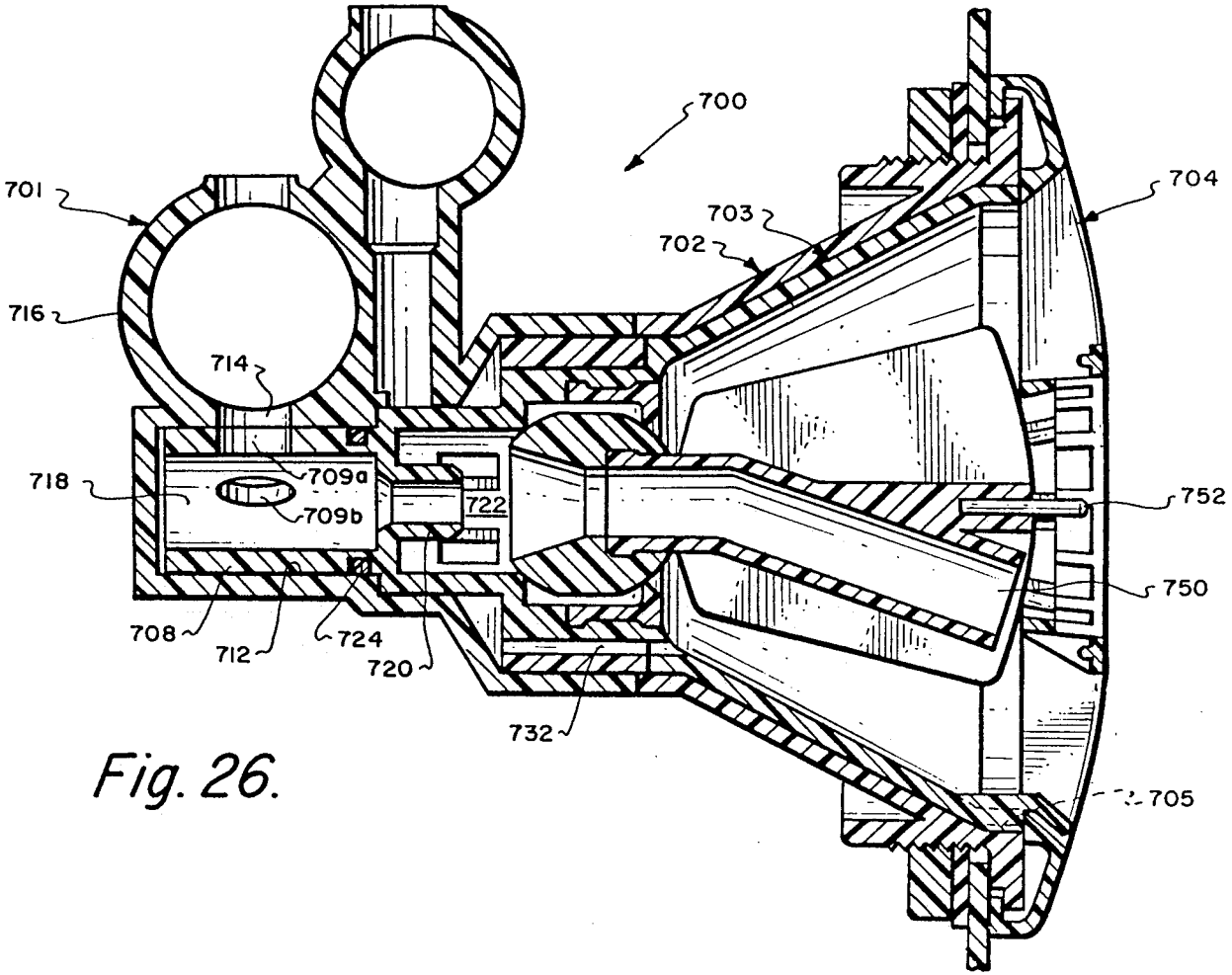
FIG. 26 is a sectional view of a fifth embodiment of the invention incorporating means for selectively adjusting the amount of air entrainment, water entrainment and supplied water jet.
Figure 27:
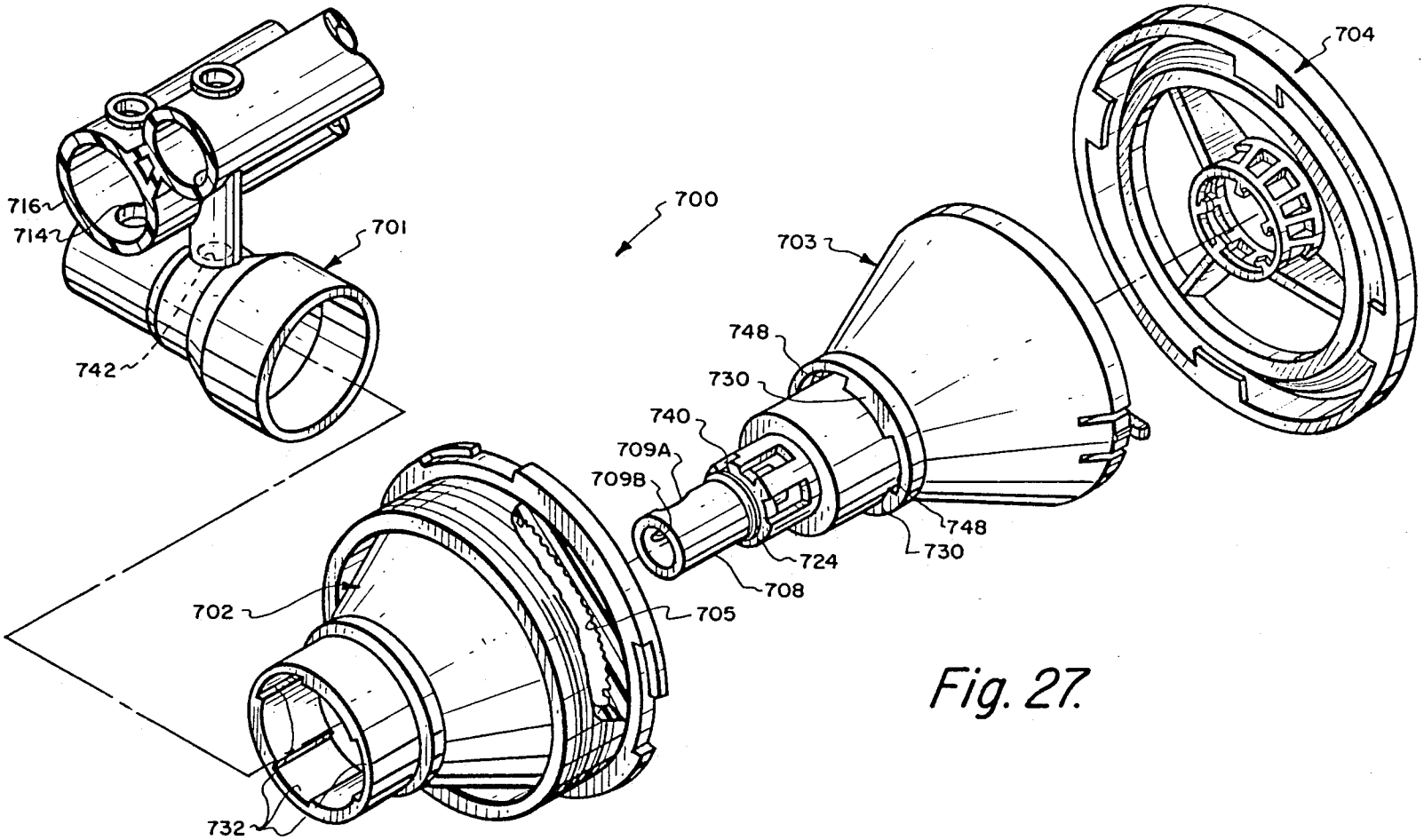
FIG. 27 is an exploded isometric view of the embodiment of FIG. 26.

Attention is now directed to FIGS. 26 and 27 which illustrate a still further embodiment 700 of the invention. The apparatus 700 of FIGS. 26, 27 is similar to the apparatus 500 of FIGS. 19–25 except that the apparatus 700 is configured to afford the user greater control over characteristics of the discharge stream. Specifically, in the apparatus 700, the user is able to readily control the amount of air entrainment and/or water entrainment and/or supplied water jet to thereby vary the momentum of the discharge stream. Table II below summarizes the operation of the apparatus 700 for various degrees of rotational position of the inner housing over a range from 0° (air entrainment open, water entrainment closed) to 75° (air entrainment closed, water entrainment open). Note from Table II that as the inner housing is rotated from a 0° to a 35° position, the water supply jet is gradually closed to reduce the momentum of the discharge stream. From an angle of about 40° to 75°, the water supply jet is gradually opened to increase the momentum of the discharge stream. Thus, as will be seen, in the apparatus 700, the user is able to vary the momentum of the discharge stream while operating either in the air entrainment mode (approximately 0° to 35°) or in the water entrainment mode (approximately 40° to 75°).

TABLE II

| | Rotation Angle | Water Entrain | Water Supply | Air Entrain | Discharge Momentum |
|---|---|---|---|---|---|
| AIR | 0° (stop) | CLOSED | OPEN | OPEN | +4 |
| ENTRAIN. | | | . | . | . |
| MODE | 35° | CLOSED | SMALL | CLOSED | +½ |
| WATER | 40° | SMALL | SMALL | CLOSED | SMALL |
| ENTRAIN. | | . | . | | . |
| MODE | 75° (STOP) | OPEN | OPEN | CLOSED | +4 |

The apparatus 700 is comprised of an aerator body 701, an outer housing 702, an inner housing 703, and a front grill 704. The grill 704 is identical to the grill 504 of apparatus 500. The outer housing 702 is identical to the outer housing 502 of apparatus 500 except that the tooth rack 705 is dimensioned to permit rotation of the inner housing 703 through 75°. Most significantly, the apparatus 700 differs from the apparatus 500 in that the inner housing 703 and aerator body 701 are configured to control the magnitude of the supplied water jet.

More specifically, note in FIGS. 26 and 27 that the inner housing 703 is provided with an additional rearwardly extending cylindrical section 708 having first and second circumferentially spaced water supply openings 709A, 709B formed therein.

As is depicted in FIGS. 26 and 27, when the inner housing 703 is nested within the outer housing 702, the cylindrical section 708 extends rearwardly beyond the outer housing 702 into an internal chamber 712 of the aerator body 701. When the inner housing 703 is properly seated in outer housing 702, the water supply openings 709 align axially with a port 714 fixedly formed in the water supply nipple 716. When an opening 709 is rotationally aligned with port 714, pressurized water supplied to the nipple 716 can flow through port 714 and then through an opening 709 into chamber 718. Chamber 718 communicates with a nozzle 720 which, in contrast to the apparatus 500, is formed as part of the structure of the inner housing 703. Pressurized water supplied to the nozzle 720 will be discharged into mixing chamber 722, corresponding to the aforementioned mixing chamber 532 of apparatus 500. Note in FIGS. 26 and 27 that an O-ring 724 is preferably provided around cylindrical section 708 to prevent water leakage therepast from water supply port 714 into the mixing chamber 722.

Figure 28A:
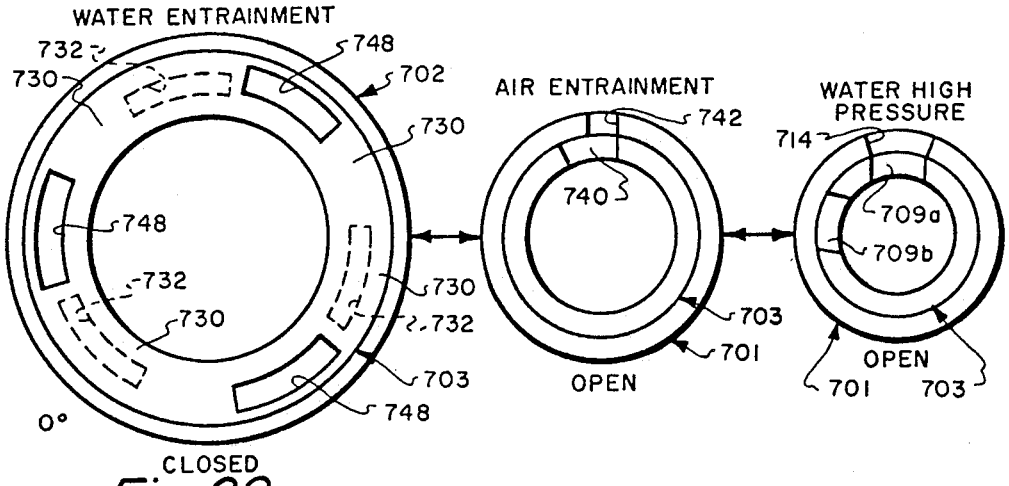
FIGS. 28*a*, 28*b*, 28*c*, are schematic representations showing the valve orientations for water entrainment, air entrainment, and water supply for various degrees of rotation of the control member of the embodiment depicted in FIGS. 26 and 27.
Figure 28B:
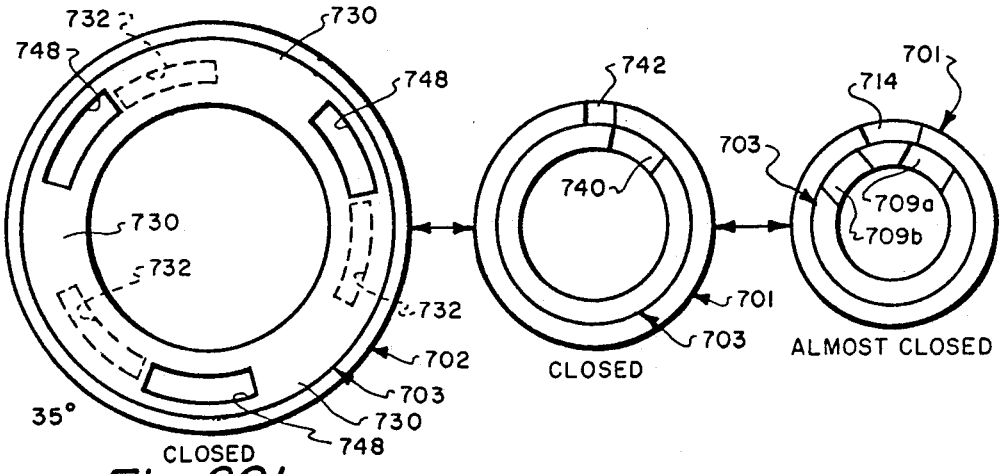
Figure 28C:
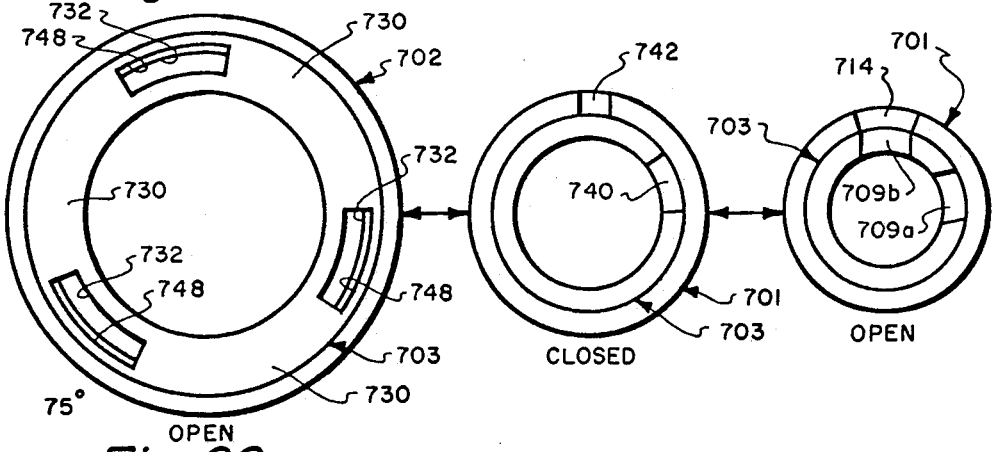

Attention is now directed to FIGS. 28*a*, 28*b*, and 28*c* which schematically depict the operation of the apparatus 700 for various degrees of rotation of the inner housing 703 relative to the outer housing 702. For a 0° rotation (FIG. 28*a*), note that the water entrainment path is closed as a consequence of inner housing tabs 730 blocking outer housing slots 732. At 0°, the air entrainment passageway is open as a consequence of the inner housing air orifice 740 aligning itself with the aerator body air port 742. The air orifice 740 is preferably tear drop shaped so that as it sweeps past air port 742 (FIG. 28*a*), it can gradually open or close the air entrainment passageway. FIG. 28*a* also depicts the relationship between the movable water supply opening 709A and the fixed water supply port 714 at 0°. That is, at 0° the high pressure water supply path from nipple 716 to nozzle 720 will be fully open. It should, of course, be appreciated that the schematic representation of FIG. 28*a* corresponds to the 0° entry in the foregoing Table II.

As the inner housing 703 is rotated clockwise by 35° from the position of FIG. 28*a* to the position of FIG. 28*b*, note that the water entrainment path will remain closed, the air entrainment path will move from fully open to closed, and the high pressure water path will move from fully open to almost closed. It is as a consequence of this variability that the user is able to vary the momentum of the discharge stream, as represented in Table II, while continuing to operate in the air entrainment mode. Rotational movement through another 40° to the 75° position represented in FIG. 28*c* opens the water entrainment passageway as the inner housing slots 748 move into alignment with the outer housing slots 732. Thus from approximately 35° to 75°, the water entrainment passageway gradually opens. During this movement, the air entrainment passageway remains closed as is depicted in FIG. 28c. However, during this movement from the 35° position (FIG. 28b) to the 75° position (FIG. 28c), the high pressure water supply gradually opens as the second water orifice 709b moves into alignment with the high pressure water supply port 714.

Except for the users greater ability to control the characteristics of the discharge stream, the apparatus 700 will operate similarly to the apparatus 500 of FIGS. 19–25. Thus, the conduit discharge orifice 750 will describe a substantially random path as the pin 752 moves from recess to recess in the front grill 704.

From the foregoing, it should now be recognized that several travelling discharge hydrotherapy embodiments have been disclosed herein for discharging a stream for impacting against a user while concurrently causing the stream discharge orifice to move along a path defining an area oriented substantially perpendicular to the primary direction of stream discharge. In the embodiments disclosed herein the travel path is characterized by a series of small circular or semicircular path segments linked by translational path segments with the discharge orifice moving along the path attributable to reaction forces produced by the discharged stream. It is pointed out that although several aspects of the foregoing invention have been disclosed in travelling discharge hydrotherapy embodiments in which the discharge orifice moves along a somewhat random path, certain features are well adapted for use in other hydrotherapy embodiments in which, for example, the discharge orifice is guided along a specifically defined path, of the type, for example, disclosed in applicants' prior U.S. Pat. No. 4,692,950. That is, the valving arrangements shown in the embodiments of FIGS. 19–25 and FIGS. 26, 27 of this application also find utility in travelling hydrotherapy embodiments in which the discharge orifice movement is restricted to a specifically defined path.

We claim:

1. Hydrotherapy apparatus for discharging a fluid stream useful for impacting against and massaging an area of a user's body, said apparatus comprising:

supply means including a cavity and means for discharging a water jet along a defined axis into said cavity for creating a suction therein;

an elongated rigid conduit including a tubular supply section having a supply orifice and a tubular discharge section having a discharge orifice;

means mounting said conduit with said supply orifice opening to said cavity whereby water supplied from said jet will flow through said conduit to said discharge orifice;

said discharge orifice being oriented to discharge a water stream having a primary massage component extending substantially in the direction of said conduit elongation and a secondary thrust component extending substantially perpendicular to said conduit elongation;

said mounting means including swivel means supporting said conduit supply section for rotation about the axis of said supply section and about vertical and horizontal axes oriented perpendicular to said supply section axis whereby said discharge orifice can translate along a random path describing a substantially planar area;

passageway means for drawing water from outside said conduit into said cavity to mitigate the effect of said suction on said conduit; and control means for varying the flow of water through said passageway means.

2. Hydrotherapy apparatus for discharging a fluid stream useful for impacting against and massaging an area of a user's body, said apparatus comprising:

supply means including a cavity and means for discharging a water jet along a defined axis into said cavity for creating a suction therein;

an elongated rigid conduit including a tubular supply section having a supply orifice and a tubular discharge section having a discharge orifice;

means mounting said conduit with said supply orifice opening to said cavity whereby water supplied from said jet will flow through said conduit to said discharge orifice;

said discharge orifice being oriented to discharge a water stream having a primary massage component extending substantially in the direction of said conduit elongation and a secondary thrust component extending substantially perpendicular to said conduit elongation;

said mounting means including swivel means supporting said conduit supply section for rotation about the axis of said supply section and about vertical and horizontal axes oriented perpendicular to said supply section axis whereby said discharge orifice can translate along a random path describing a substantially planar area;

passageway means for drawing water from outside said conduit into said cavity to mitigate the effect of said suction on said conduit;

said supply means further including means for supplying air to said cavity; and control means for varying the flow of water and/or air to said cavity.

3. The apparatus of claim 2 wherein said control means includes valve means mounted for movement from a first to a second position, said valve means operable to progressively close down said water flow and open said air flow to said cavity while moving from said first to said second position.

4. The apparatus of claim 2 wherein said control means further includes means for varying the flow of said water jet into said cavity.

5. Hydrotherapy apparatus suitable for mounting in an opening of a water tub peripheral wall for discharging a water stream into said tub for impacting against a user's body, said apparatus including:

housing means defining a mixing chamber;

means for discharging a water jet along a defined axis into said chamber for creating a suction therein;

conduit means having an inlet orifice at a first end and a discharge orifice at a second end;

means mounting said conduit means proximate to said first end with said inlet orifice open to said mixing chamber and substantially aligned with said water jet axis, said mounting means permitting said discharge orifice to travel along a path defining an area;

means producing a force for moving said discharge orifice along said path;

water entrainment passageway means for passing water from said tub into said chamber, drawn by said suction, for entrainment by said water jet to thus produce said water stream comprised of said entrained tub water and said water jet for impacting against a user's body; and control means for varying the flow of water through said passageway means.

6. The apparatus of claim 5 further including:

air entrainment passageway means coupling an air source to said chamber for passing air from said source into said chamber, drawn by said suction, for entrainment by said water jet; and wherein said control means includes means for varying the flow of air through said air entrainment passageway means.

7. The apparatus of claim 5 wherein said control means includes means for varying the flow from said water jet into said chamber.

8. The apparatus of claim 6 wherein said control means includes means for varying the flow from said water jet into said chamber.

9. The apparatus of claim 5 wherein said means for discharging said water jet includes a nozzle fixedly mounted proximate to said chamber; and electrically driven pump means for drawing water from said tub for discharge through said nozzle.

10. The apparatus of claim 5 wherein said control means includes:

a valve member mounted for movement from a first to a second position for closing down said passageway means.

11. The apparatus of claim 10 wherein said control means further includes:

a control member for manual movement by a user in said tub; and means coupling said control member to said valve member.

12. The apparatus of claim 6 wherein said control means includes valve means mounted for movement from a first to a second position, said valve means operable to progressively close down said water passageway means while concurrently opening up said air passageway means while moving from said first to said second position.

13. The apparatus of claim 8 wherein said control means includes valve means mounted for movement from a first to a second position, said valve means operable to concurrently progressively close down said water passageway means, open said air passageway means, and vary said flow from said water jet while moving from said first to said second position.

14. The apparatus of claim 5 wherein said conduit means comprises an elongated rigid conduit; and wherein said discharge orifice is oriented to discharge a water stream having a primary massage component extending substantially in the direction of said conduit elongation and a secondary thrust component extending substantially perpendicular to said conduit elongation for thrusting said discharge orifice along said path.

15. Hydrotherapy apparatus suitable for mounting in an opening of a water tub peripheral wall for discharging a water stream into said tub for impacting against a user's body, said apparatus including:

housing means defining a mixing chamber;

means for discharging a water jet along a defined axis into said chamber for creating a suction therein;

conduit means having an inlet orifice at a first end and a discharge orifice at a second end;

means mounting said conduit means proximate to said first .end with said inlet orifice open to said mixing chamber and substantially aligned with said water jet axis, said mounting means permitting said discharge orifice to travel along a path defining an area;

means for producing a force to move said discharge orifice along said path;

said housing including air entrainment passageway means coupling an air source to said chamber for passing air from said source into said chamber, drawn by said suction, for entrainment by said water jet; and control means operatively associated with said housing for selectively varying the flow of air through said passageway means for entrainment by said water jet to produce said water stream for impacting against the user's body.

16. Hydrotherapy apparatus suitable for mounting in an opening of a water tub peripheral wall for discharging a water stream into said tub for impacting against a user's body, said apparatus including:

housing means defining a mixing chamber;

means for discharging a water jet along a defined axis into said chamber for creating a suction therein;

conduit means having an inlet orifice at a first end and a discharge orifice at a second end;

means mounting said conduit means proximate to said first end with said inlet orifice open to said mixing chamber and substantially aligned with said water jet axis, said mounting means permitting said discharge orifice to travel along a path defining an area;

means for producing a force to move said discharge orifice along said path; and control means in said housing for varying the flow from said water jet into said chamber.

17. In combination:

a tub for containing a water pool, said tub having a peripheral wall including a discharge opening and a water return opening formed therein;

a housing mounted in alignment with said discharge opening, said housing defining a mixing chamber and including nozzle means for supplying a water jet along a defined axis into said chamber for creating a suction therein;

conduit means having an inlet orifice at a first end and a discharge orifice at a second end;

means mounting said conduit means proximate to said first end with said inlet orifice open to said mixing chamber and substantially aligned with said water jet axis, said mounting means permitting said discharge orifice to travel along a path defining an area;

means producing a force for moving said discharge orifice along said path;

first passageway means open to said water pool and communicating with said chamber for passing water from said pool into said chamber, drawn by said suction, for entrainment by said water jet;

second passageway means open to a source of air and communicating with said chamber for passing air, drawn by said suction, for entrainment by said water jet;

first valve means for varying the flow of water through said first passageway means;

second valve means for varying the flow of air through said second passageway means; and manually operable control means for controlling said first and second valve means for producing a water stream comprised of said water jet and entrained water from said pool or entrain air from said air source for impacting against a user's body.

18. The combination of claim 17 further including:

electrically driven pump means having an inlet side coupled to said water return opening and an outlet side coupled to said nozzle means for drawing tub pool water and supplying pressurized water to said nozzle means.

19. The combination of claim 17 wherein said control means comprises a single control member mounted for rotation; and means coupling said control member to said first and second valve means.

20. The combination of claim 17 including third valve means for varying the magnitude of said supplied water jet.

21. The apparatus of claim 17 wherein said conduit means comprises an elongated rigid conduit; and wherein said discharge orifice is oriented to discharge a water stream having a primary massage component extending substantially in the direction of said conduit elongation and a secondary thrust component extending substantially perpendicular to said conduit elongation for thrusting said discharge orifice along said path.

* * * * *